United States Patent [19]

Crooks et al.

[11] Patent Number: 5,007,518

[45] Date of Patent: Apr. 16, 1991

[54] APPARATUS FOR RENTING ARTICLES

[75] Inventors: Theodore J. Crooks, La Mesa; Terry L. Zentz; Matthew G. Morris, both of San Diego, all of Calif.

[73] Assignee: Sam Crivello, San Diego, Calif.

[21] Appl. No.: 309,353

[22] Filed: Feb. 13, 1989

[51] Int. Cl.[5] ..... G07F 7/00; G07F 11/52

[52] U.S. Cl. ..... 194/212; 221/79; 414/787

[58] Field of Search ..... 194/205, 212; 221/6, 221/14, 79, 120, 121, 132; 414/280, 331, 787, 932

[56] References Cited

U.S. PATENT DOCUMENTS

| | | | |
|---|---|---|---|
| 1,791,078 | 2/1931 | Fitch . | |
| 1,809,693 | 6/1931 | Hahling . | |
| 1,866,716 | 7/1932 | McCormick et al. . | |
| 2,887,204 | 5/1959 | Giuliano | 198/4 |
| 3,061,143 | 10/1962 | Simjian | 221/2 |
| 3,134,016 | 5/1964 | Connolly et al. | 235/152 |
| 3,224,544 | 12/1965 | Shoher | 194/240 |
| 3,267,436 | 8/1966 | Alpert et al. | 340/172.5 |
| 3,401,830 | 9/1968 | Mathews | 221/2 |
| 3,457,391 | 7/1969 | Yamamoto | 235/61.6 |
| 3,560,715 | 2/1971 | Osaka | 235/61.8 |
| 3,602,695 | 8/1971 | Boss | 235/61.7 |
| 3,629,834 | 12/1971 | Randall | 340/149 |
| 3,662,343 | 5/1972 | Goldstein et al. | 340/149 |
| 3,691,527 | 9/1972 | Yamamoto | 340/149 |
| 3,705,384 | 12/1972 | Wahlberg | 340/149 |
| 3,718,906 | 2/1973 | Lightner | 340/147 |
| 3,760,162 | 9/1973 | Holter | 235/61.11 |
| 3,761,682 | 9/1973 | Barnes | 235/61.7 |
| 3,778,595 | 12/1973 | Hatanaka | 235/61.7 |
| 3,845,470 | 10/1974 | Schuller | 340/149 |
| 3,862,716 | 1/1975 | Black et al. | 235/61.7 |
| 3,908,894 | 9/1975 | Hatanaka et al. | 235/61.6 |
| 3,914,579 | 10/1975 | Shigemori et al. | 235/61.7 |
| 3,943,335 | 3/1976 | Kinker et al. | 235/61.7 |
| 4,011,433 | 3/1977 | Tateisi et al. | 235/61.7 |
| 4,120,452 | 10/1978 | Kimura et al. | 235/381 |
| 4,134,537 | 1/1979 | Glaser et al. | 235/379 |
| 4,141,078 | 2/1979 | Bridges, Jr. et al. | 364/900 |
| 4,300,040 | 11/1981 | Gould et al. | 235/381 |
| 4,414,467 | 11/1983 | Gould et al. | 235/381 |
| 4,458,802 | 7/1984 | Maciver et al. | 194/205 |
| 4,519,522 | 5/1985 | McElwee | 221/79 X |
| 4,598,810 | 7/1986 | Shore et al. | 194/205 |
| 4,668,150 | 5/1987 | Blumberg | 414/273 |
| 4,860,876 | 8/1989 | Moore et al. | 221/79 X |

FOREIGN PATENT DOCUMENTS

| | | | |
|---|---|---|---|
| 1207411 | 7/1986 | Canada | 194/205 |
| 0191636 | 8/1986 | European Pat. Off. | 194/205 |
| 3617980 | 12/1987 | Fed. Rep. of Germany | 221/6 |
| 3723539 | 1/1989 | Fed. Rep. of Germany | 194/205 |

*Primary Examiner*—F. J. Bartuska

*Attorney, Agent, or Firm*—Brown, Martin, Haller & McClain

[57] ABSTRACT

An apparatus for rental of articles such as videocassettes comprises an outer housing, and a storage assembly within the housing having storage locations for storing a plurality of videocassettes. The housing has a front panel including an array of separate display areas each containing pictorial indicia representing a particular videocassette and a predetermined selection code corresponding to that videocassette, a selection device adjacent the array for allowing a user to enter the selection code of a selected videocassette, and a delivery chute for delivering selected videocassettes to users. A transport mechanism is provided for retrieving selected videocassettes from the storage assembly for delivery to users, and for returning videocassettes to the storage assembly. A control device associates each stored videocassette with its storage location and controls the transport mechanism to deliver selected videocassettes to customers.

12 Claims, 7 Drawing Sheets

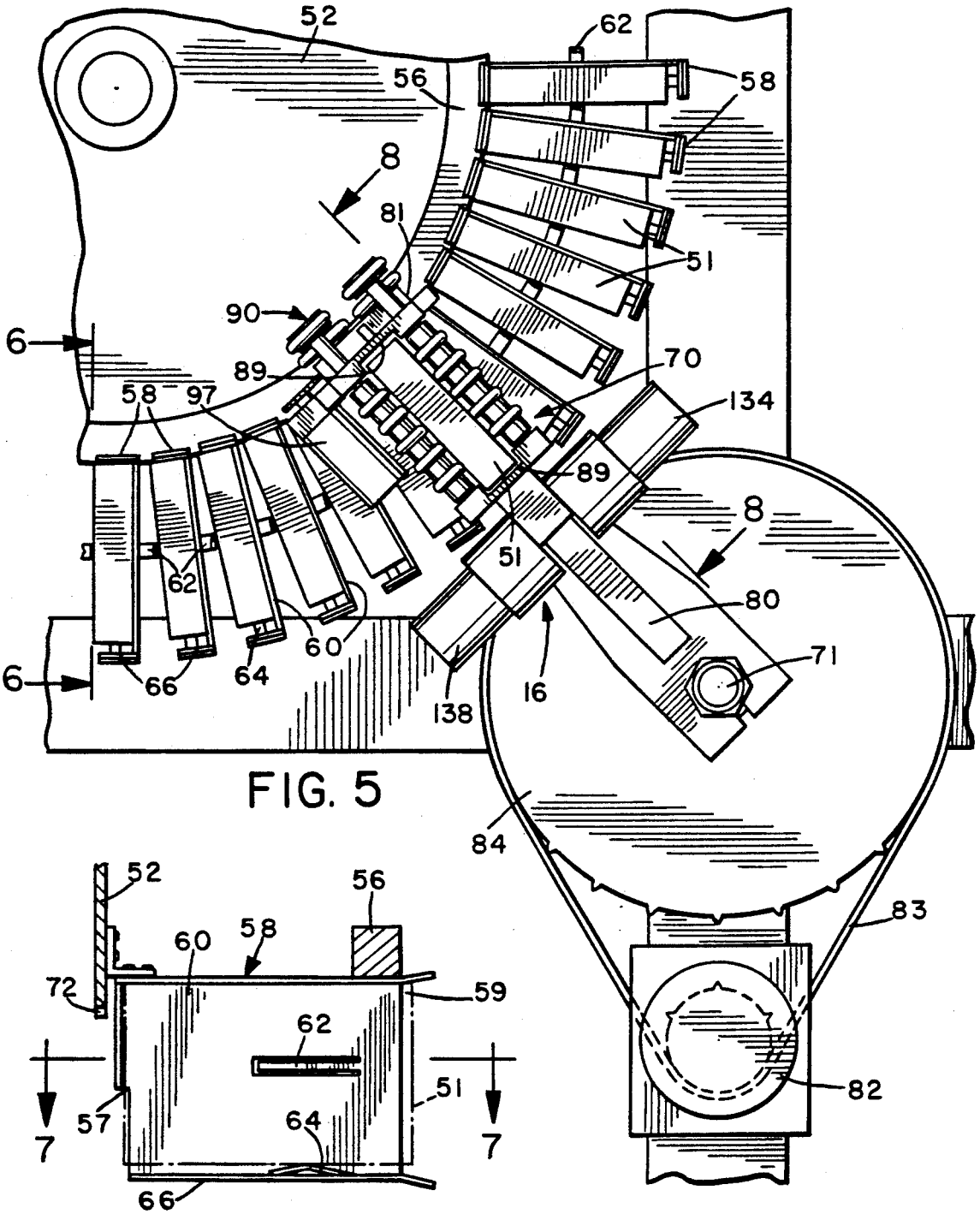
FIG. 5
FIG. 6
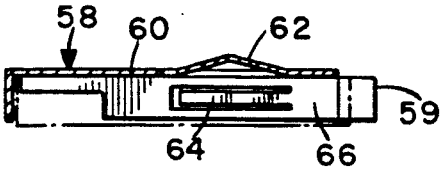
FIG. 7

APPARATUS FOR RENTING ARTICLES

BACKGROUND OF THE INVENTION

The present invention relates generally to machines for storing and dispensing re-usable articles for rental by customers and subsequent return to the machine after use. Articles which are commonly rented by customers for a relatively short time period include videocassettes or tapes, and the like. The present invention is particularly directed to a machine and method for renting videocassettes, but is applicable to any re-usable, rentable articles.

Various machines for dispensing articles for sale or rental have been proposed in the past. Videocassette rental machines generally have a video screen associated with a keyboard for the customer to enter data concerning selected videocassettes. Typically, each videocassette title is associated with a predetermined selection code which must be entered by the customer to retrieve that videocassette from the machine. The customer normally ascertains the code associated with the desired videocassette by scrolling a display of available titles and associated codes on the screen. This is inefficient, since customers can take quite a long time to make a selection, and have to repeatedly return to the listing of available titles if selections prove to be unavailable, potentially tying up the terminal for a significant length of time. In other cases, a booklet or catalog listing titles along with the appropriate codings is provided in the vicinity of the machine. Similar problems arise with this arrangement, in that customers must decide on several titles in advance in case one should prove unavailable, or repeatedly leave the control panel to refer to the listing when their requests are not available.

In U.S. Pat. No. 4,414,467 of Gould et al., a vending ordering terminal is described at which a user can selectively preview or order a videocassette. The terminal stores a plurality of videocassette and delivers selected videocassettes to users. The terminal includes a listing of the videocassettes with their unique codes from which the customer can select a desired title and enter it at the keyboard. Again, if a selected title is unavailable, the customer must make repeated selections or else abandon the attempt.

U.S. Pat. No. 4,598,810 of Shore et al. describes another film vending unit which dispenses selected films to a user. The unit is provided with a list of the titles and associated numbers of each film to be vended from the unit. Again the patron must locate the number of the film according to its title only, and if this film should be unavailable, must return to the list to select a further title. The selection process can therefore be lengthy, resulting in one customer tying up the unit for a significant time period and possibly reducing potential rental profits.

SUMMARY OF THE INVENTION

It is an object of the present invention to provide an improved method and apparatus for renting articles such as videocassettes and the like.

According to one aspect of the present invention, an apparatus for renting of articles comprises an outer housing, a storage assembly within the housing having storage locations for storing a plurality of articles, a transport mechanism for retrieving articles from the storage assembly and delivering them to customers and for receiving articles returned by customers and returning them to the storage assembly, a controller for controlling operation of the transport mechanism, the controller including a memory for storing data associating each storage location with a selection code representing an article to be stored at that location, the housing having a front panel including an array of separate display areas each containing pictorial indicia representing a respective article stored in the machine and the selection code associated with that article, and a selection device on the front panel adjacent the array and associated with the controller for allowing a customer to select an article by entering the selection code associated with that article on the selection device. Each display area on the front of the machine preferably includes an indicator for indicating whether or not that particular article is currently available. The indicators are linked to the controller or computer, which is programmed to keep track of articles rented and returned and to operate the indicators accordingly when a particular article is unavailable.

In the case of videocassettes, one or more copies of a particular title may be available in the machine, and data is stored in the computer memory to indicate the number of copies of each title normally available. Each copy of a title will have a bar code specific to that copy of the title, and the memory includes date associating each bar code with a specific storage location. The computer then keeps track of each copy of that title as it is rented, and operates the indicator on the front panel associated with that title as soon as all copies are rented. The indicators suitably comprise lights which are turned on or off according to article availability. This avoids the necessity of the customer making repeated selections until a title is found which is currently available, and speeds up the selection process considerably. The customer makes a selection of a title known to be available from the array on the front panel of the housing, which includes all titles currently available in the machine, before stepping up to the selection device, which is preferably a keypad or the like. This will be considerably less time-consuming and frustrating, since selection codes do not have to be memorized and the customer knows the selected title will be available before entering it into the machine.

According to another aspect of the invention, a method of renting articles is provided which comprises the steps of:

selecting a desired article from an array on the front panel of a machine containing the articles, the array including separate display areas each including pictorial indicia representing a respective article and an associated selection code, and having display means for indicating whether the article is currently available;

entering the selection code of a selected available article on a selection device at the front panel of the machine;

the machine associating the selection code with a predetermined storage location in the machine at which the selected article is stored; and controlling a transport mechanism in the machine to retrieve the article from its storage location and deliver it to the customer.

In a preferred embodiment of the invention, the storage and transport mechanisms comprise at least one rotatable drum having a plurality of storage compartments around its periphery in which a series of articles such as videocassettes are stored, one in each compartment, and a rotatable picker mechanism which is rotatable between a pickup position aligned with a drum compartment and a delivery position aligned with a delivery chute for delivering articles to customers. When a customer enters an article selection code, the computer associates that code with a predetermined compartment on the drum and rotates the drum until that compartment is at the pickup position, at the same time rotating the picker mechanism to the same position. The picker mechanism is then controlled to retrieve the article from its compartment, and subsequently rotated to the delivery position for delivering the article to a customer. In the preferred embodiment of the invention four storage drums are provided in a generally square configuration for added storage capability, and the picker mechanism rotates in a circle in front of the drums between four pickup positions, one each aligned with a predetermined compartment position on each of the drums, and the delivery position.

In this transport mechanism only rotational movement is used, reducing the number of variables and making conversion from rotational movement to linear movement unnecessary. System reliability is improved by reducing the total number, velocity and frequency of the moving parts. Articles can be accessed in much less time than with standard X-Y stationary storage systems, where a picker must travel over the entire storage array to cover all storage locations. With the present system, the article and picker are rotated simultaneously towards one another, and the picker mechanism is required to move only a relatively short distance in order to reach any selected article. The rotary motion simplifies position sensing, since position sensors can be placed anywhere on the storage wheels without concern about system hysteresis.

BRIEF DESCRIPTION OF THE DRAWINGS

The present invention will be better understood from the following detailed description of a preferred embodiment, taken in conjunction with the accompanying drawings, in which like reference numerals refer to like parts, and in which:

FIG. 5 is an enlargement of a central portion of FIG. 2;

FIG. 6 is a sectional view taken on line 6—6 of FIG. 5;

FIG. 7 is a sectional view taken on line 7—7 of FIG. 6;

DESCRIPTION OF THE PREFERRED EMBODIMENT

The drawings illustrate a preferred embodiment of an automatic vending or rental machine for renting re-usable articles such as videocassettes or videotapes which are kept for a short time by a customer and subsequently returned to the machine.

Figure 1:
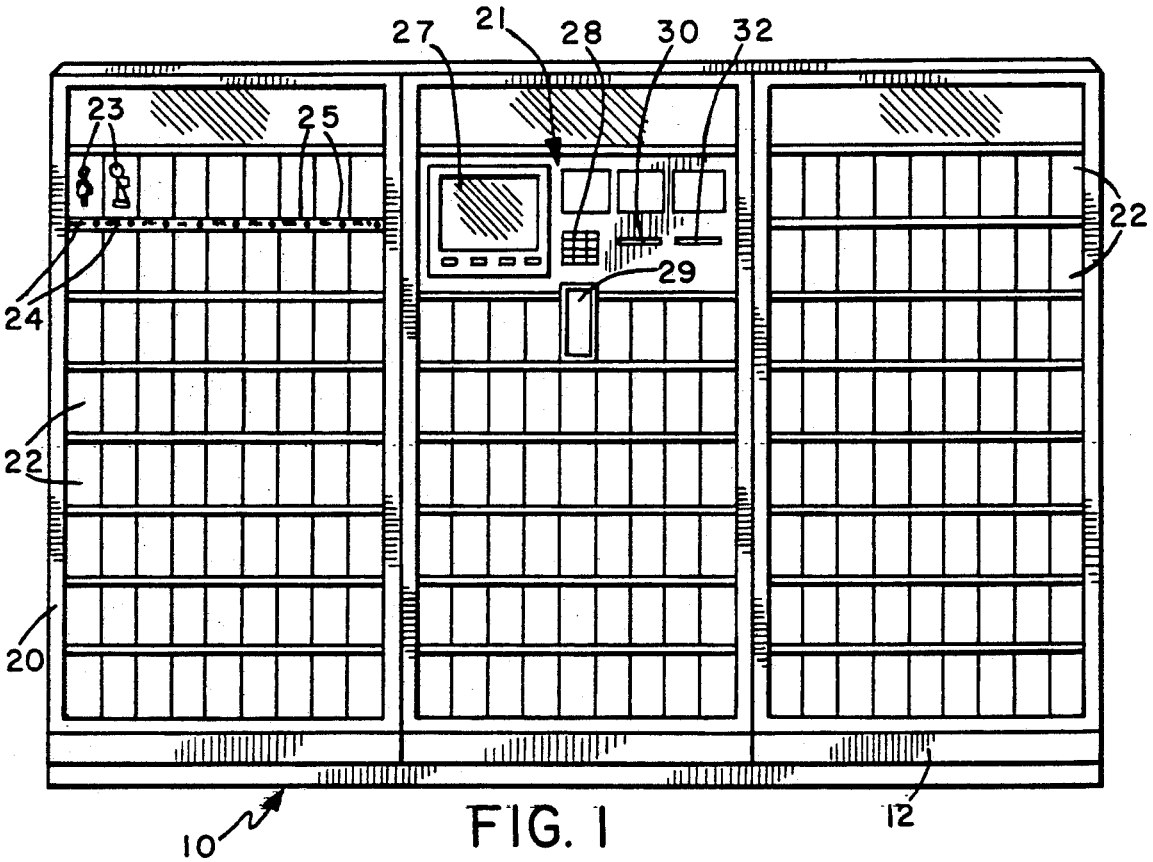
FIG. 1 is a front elevation view of the complete vending machine.
Figure 2:
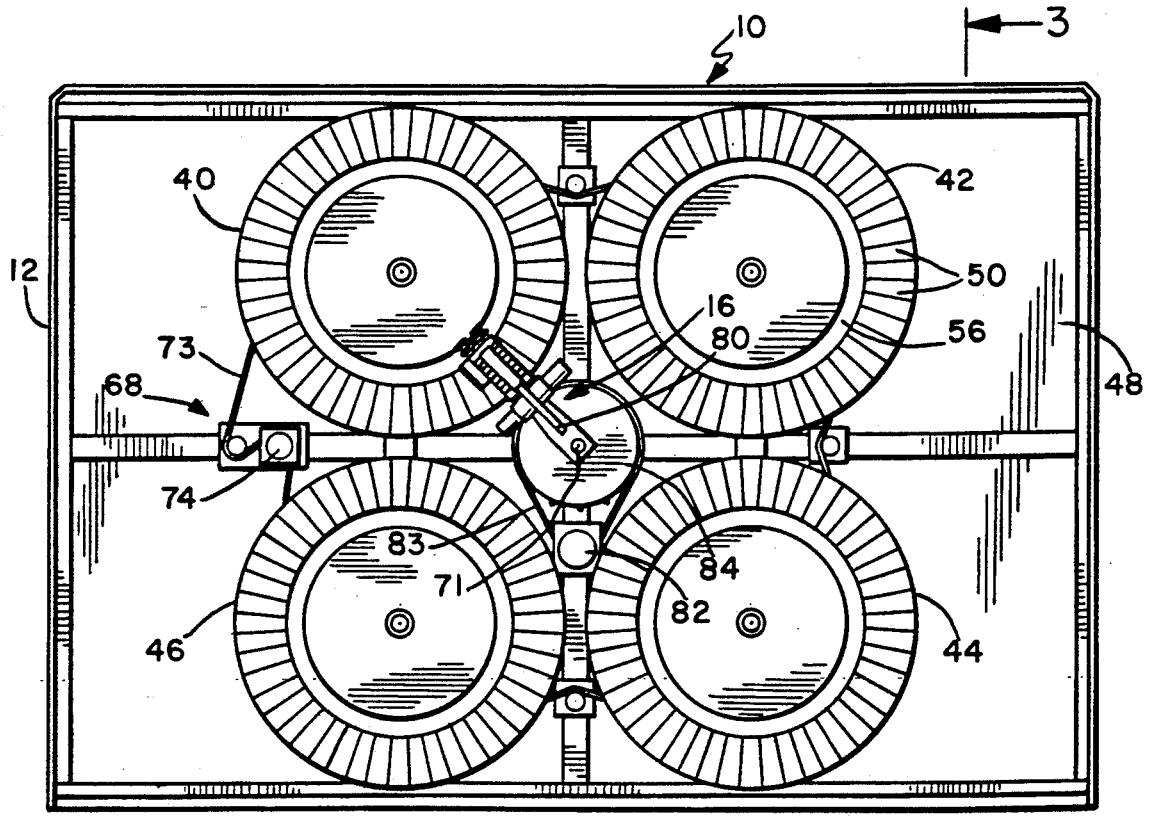
FIG. 2 is a front elevation view with the front enclosure panels removed.
Figure 3:
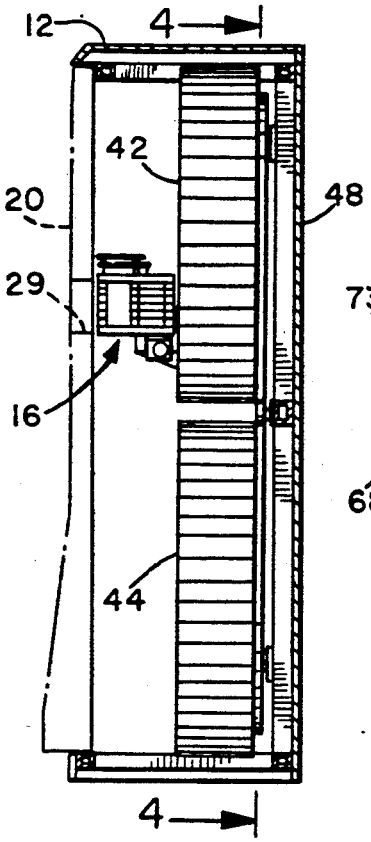
FIG. 3 is a sectional view taken on line 3—3 of FIG. 2.

As best shown in FIGS. 1 and 2, the machine 10 basically comprises an outer housing 12 having an internal storage assembly 14 for holding a plurality of videocassettes, and a transport mechanism 16 for removing videocassettes from the storage assembly and delivering them to customers, and replacing videocassettes returned by customers into the storage assembly. Operation of the transport mechanism is controlled by a suitably programmed computer 18 (illustrated diagrammatically in FIG. 15) as explained in more detail below. The computer and interface circuitry between the computer and the various peripheral devices will be mounted inside housing 12.

The front wall 20 of the housing includes a customer terminal 21 allowing the customer to communicate with the system, and an array of display areas 22 adjacent the terminal 21 each containing a pictorial representation 23 of a particular videocassette stored in the machine, a selection code 24 representing that videocassette adjacent the representation, and an indicator light 25, such as an L.E.D., for indicating the availability of that particular videocassette. The front wall in the preferred embodiment is divided into three separate panels, each of which are hinged to the housing frame to provide access for maintenance and drainage in the display areas.

The terminal 21 includes a video display unit or screen 27 for displaying pre-programmed messages and instructions, a control panel or keyboard unit 28 for allowing customers to enter suitable control functions, an outlet or delivery chute 29 for delivering rented videocassettes and receiving returned videocassettes, a credit card entry slot 30, and a receipt dispensing slot 32.

In the preferred embodiment shown, each display area contains a film transparency showing the artwork from the respective videocassette box, which is backlit by a suitable lamp. Adjacent the transparency is the predetermined selection code 24 representing that particular videocassette, and the indicator light or LED 25 indicating availability of that particular title. The display areas can be updated as the machine is re-stocked with newer titles, by simply removing the old transparencies and replacing them with appropriate new transparencies. The artwork for all of the different titles stored in the machine is preferably displayed on the front panel in this manner, so that the user can immediately determine what is available, as well as the appropriate selection code for the desired videocassette.

The storage assembly and transport mechanism will now be described in more detail, with reference to FIGS. 2 to 13 which illustrate the detailed operation of this mechanism. In the preferred embodiment, the storage assembly comprises a square array of four, co-planar rotatable drums or wheels 40, 42, 44, 46 mounted vertically on a rear wall 48 of the housing. Each drum has a series of tape holder slots or compartments 50 around its periphery for holding videotapes 51. In the preferred embodiment of the invention, each wheel comprises a backplate 52 rotatably mounted on the rear wall 48 of the housing, a front ring 56 spaced from the backplate, and a series of tape holders 58 mounted on the back plate and extending between the back plate and ring as indicated in FIGS. 5 to 7 and 14 to define the tape holder slots 50. Ring 56 may be omitted if desired. Each holder 58 is three-sided, with an open forward end 59 to allow tapes to be removed and replaced, an opening 57 at its rear end (see FIG. 8), and one open side facing the side wall 60 of the next adjacent holder. Each holder is designed with built in springs 62, 64 in its side wall 60 and one end wall 66 to hold the tape box up against the internal surfaces of the holder for positioning. Spring 62 in the side wall 60 is designed to urge the tape box in the next adjacent holder up against the side wall of that holder, as can be seen in FIG. 5. The springs prevent or reduce migration of the tapes as the wheels turn. As shown in FIG. 6, fluted leading surfaces are provided at the open forward end of each tape holder or compartment. The tape holders may be in a reverse orientation to that shown in FIG. 5, if desired, i.e. so that walls 60 are on the left-hand side rather than the right-hand side as shown. In this case, walls 60 will be lowermost when the drum rotates past a pickup position, explained in more detail below, so that gravity helps to hold cassettes against the respective walls 60 in the pickup position.

The transport mechanism comprises a drive assembly 68 for driving all four drums simultaneously, together with a picker assembly 70 rotatably mounted on the rear wall of the housing so as to rotate in a vertical plane parallel to the plane of the drums and across part of the front faces of all four drums, as indicated in FIG. 2. The arm rotates on a rotatable drive shaft 71 which extends horizontally through the center of the drum array. The arm rotates between five positions, one position for each drum aligned with a particular tape holder home position on that drum and one position aligned with inner end of the delivery chute.

Figure 4:
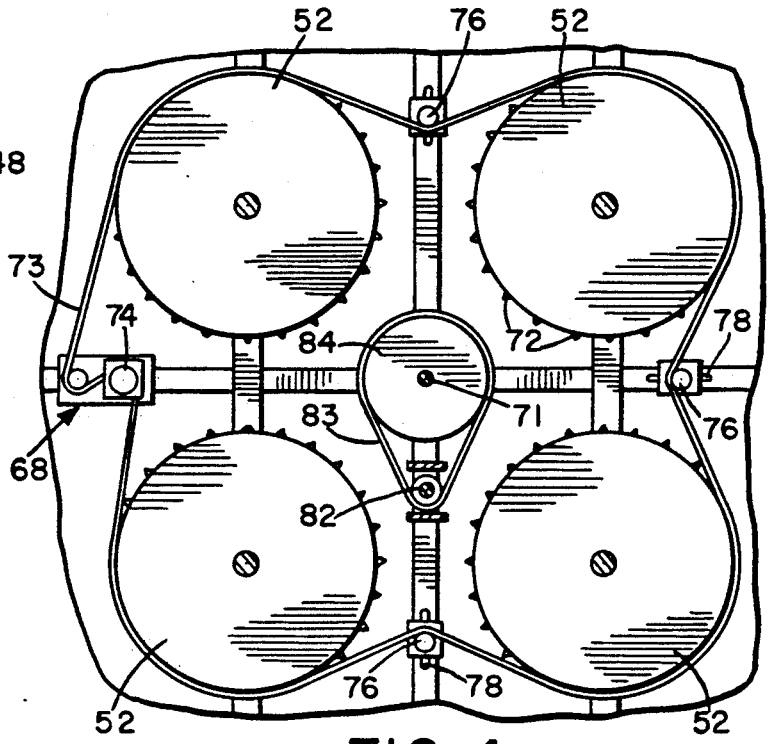
FIG. 4 is a sectional view taken on line 4—4 of FIG. 3.
Figure 14:
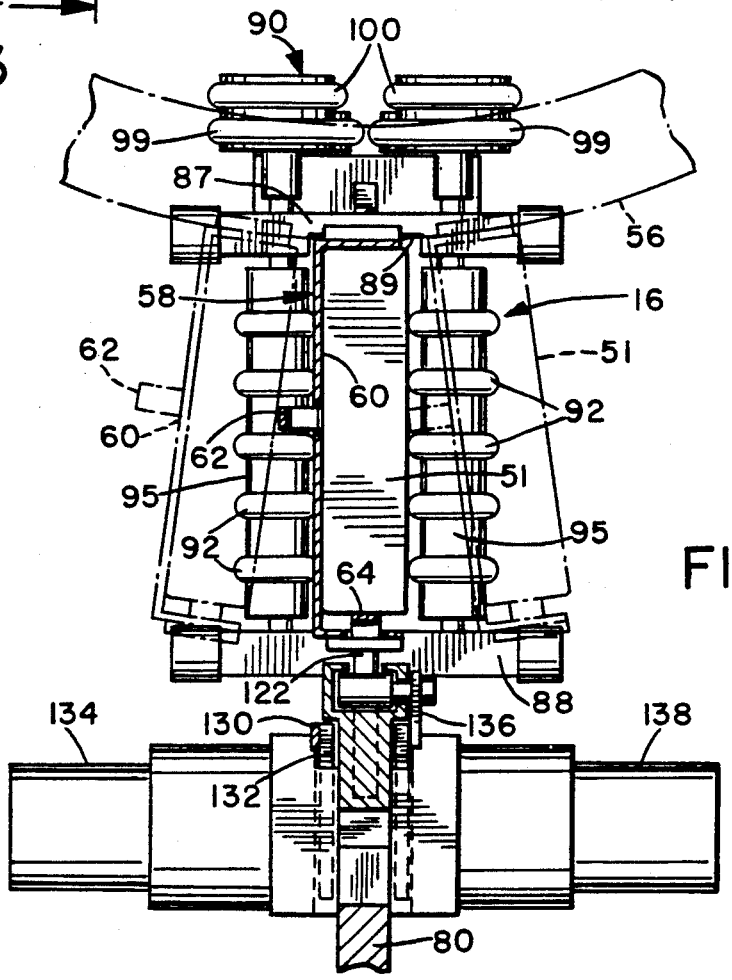
FIG. 14 is a sectional view taken on line 14—14 of FIG. 9.

The drum drive assembly is illustrated in more detail in FIG. 4. As shown, each drum back plate has teeth 72 cut into its outer diameter, allowing the plate to double as a driven sprocket or gear wheel. The drums are mechanically linked together via continuous drive chain 73 which extends around the four back plates and is driven by stepper motor 74. Adjustment members 76 are provided between each of the four plates and are movable in slots 78 to align the drums during calibration to set up the desired home positions of each drum so that the desired tape holder positions are aligned with the four pickup positions of the picker arm. Suitable drum position sensors (not shown) are provided for use during calibration.

The picker assembly is illustrated in more detail in FIGS. 5 and 8 to 14. The assembly comprises an arm 80 projecting from the drive shaft 71 towards the periphery of a circle extending across the innermost peripheral edges of the drums, and a picker member 81 mounted at the free end of the arm so as to face the front end of a tape holder when located at the home position of any one of the drums (see FIGS. 5, 8 and 9).

As best shown in FIG. 5, the picker arm is driven in a circular path across part of the front face of all four storage wheels on drive shaft via stepper motor 82 which is linked to drive shaft 71 via a drive chain or belt 83 extending around a relatively large diameter toothed gear wheel or drive sprocket 84 rotatably mounted on the rear wall of the housing.

Figure 13:
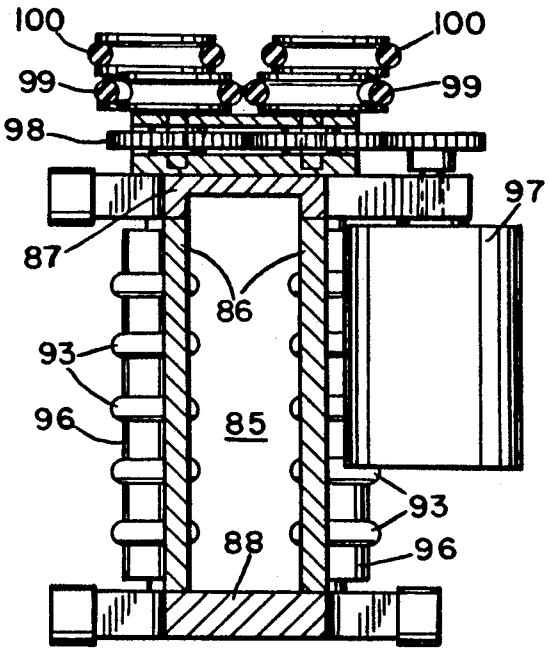
FIG. 13 is a sectional view taken on line 13—13 of FIG. 8.
Figure 12:
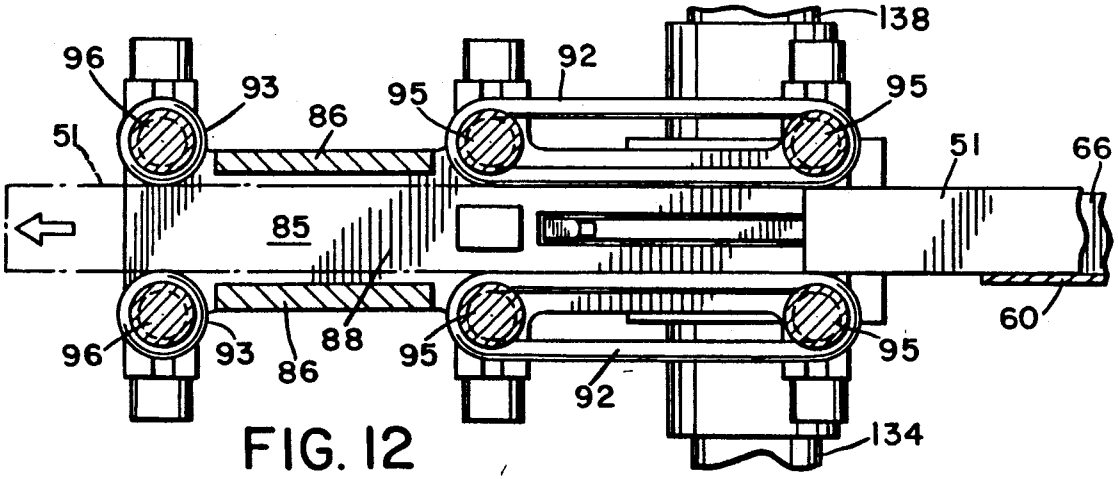
FIG. 12 is a sectional view taken on line 12—12 of FIG. 9.

As best illustrated in FIGS. 5 and 13, picker member 81 has a retainer slot 85 which is open at opposite ends and which is aligned with a tape holder when positioned at the home position of one of the storage wheels, in order to retrieve a tape from, or return a tape to, the holder. The slot is dimensioned to receive a tape box 51, and has opposite side walls 86 and upper and lower walls 87, 88 respectively. Indents 89 in the upper and lower walls serve to position the tape more precisely.

Figures 9, 10:
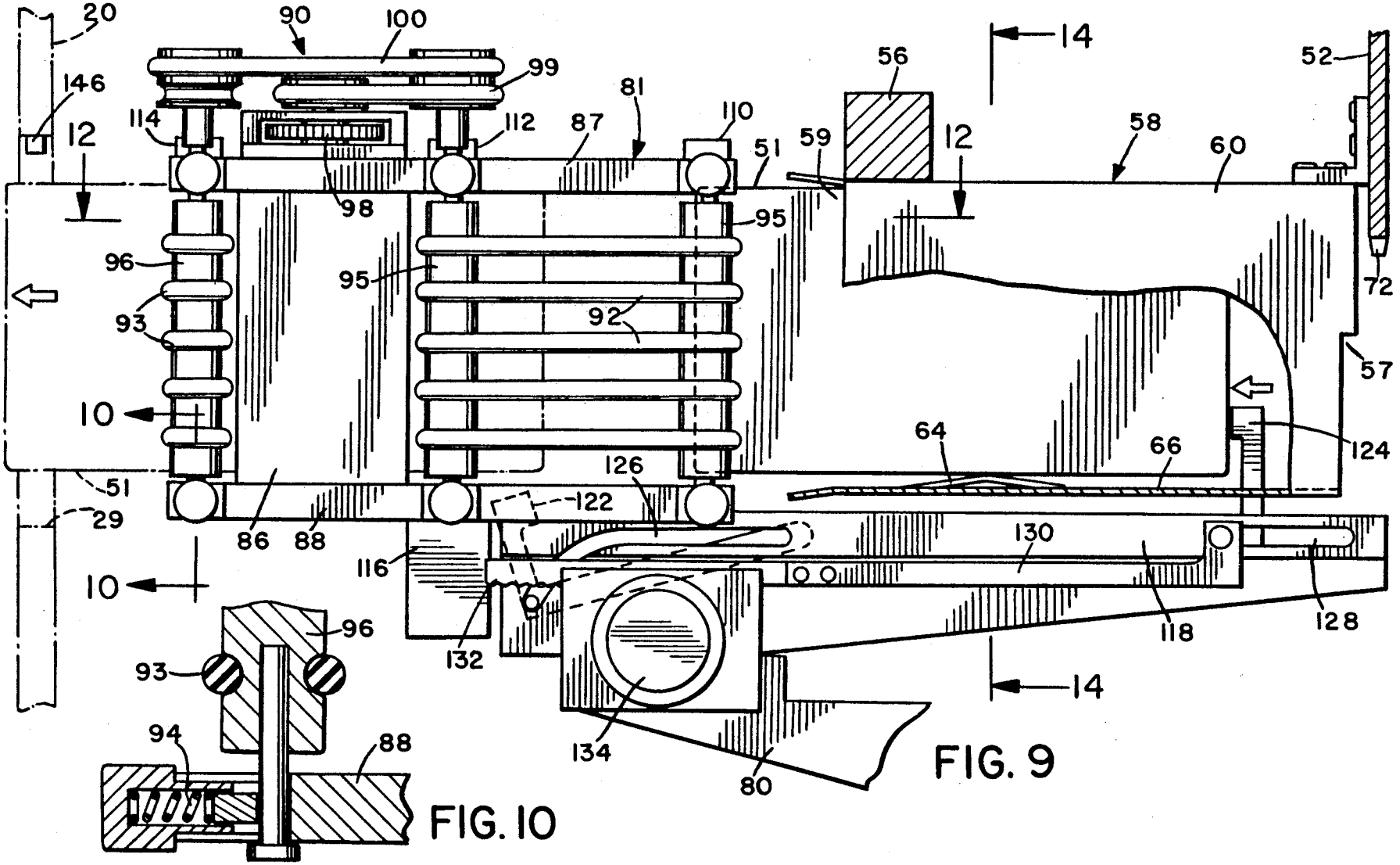
FIG. 9 is a view similar to FIG. 8, showing the cassette ejection action.
FIG. 10 is an enlarged sectional view taken on line 10—10 of FIG. 9.
Figure 11:
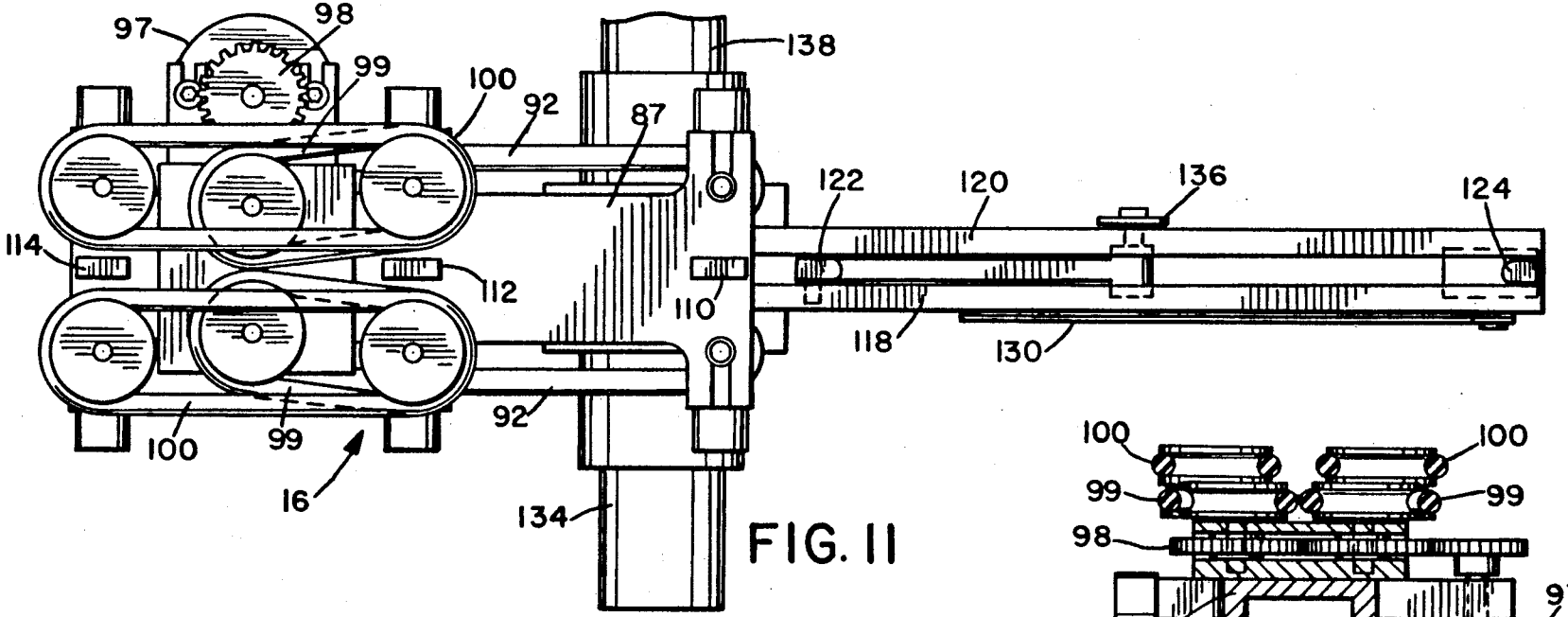
FIG. 11 is a top plan view of the picker mechanism as illustrated in FIG. 9, with the cassette holder omitted.

Tapes are driven into and out of the opposite ends of the retainer slot 85 on the picker assembly by means of a conveyer belt assembly 90, and an injector and ejector mechanism 91. The conveyer belt assembly 90 consists of two sets of conveyer belts 92, 93 which are mounted in the opposite side walls 86 of the slot and project through openings in the side walls to engage any tape which may be positioned in the slot. The belts are biased inwardly by spaced springs 94, as illustrated in FIG. 10, so that they positively engage any tape located between the belts and also allow free play so that the tape can freely enter the slot. As best illustrated in FIGS. 9 to 13, the first, longer set of conveyer belts 92 extend around rollers 95 at opposite ends, which are rotatably mounted in the upper and lower walls of the slot. The second set 93 extends around a single drive roller 96 at the opposite end of the slot, and roller 96 is also rotatably mounted in the upper and lower walls of the slot. The rollers 95 and 96 on opposite sides of the slot are rotated by reversible conveyer belt motor 97, which is linked to the drive rollers via gear wheels 98 and belts 99, 100, as illustrated in FIGS. 9, 11 and 13.

Three sets of optical sensors 110, 112, 114 are provided along the length of the tape retaining slot, one at each end and one at the center, as indicated in FIG. 11, for detecting the position of a tape and operating the conveyer belt motor accordingly, as explained in more detail below. A suitable bar code reader 116 is also mounted in one wall of the slot, as indicated schematically in FIG. 9, in a position such that it can scan and read the bar code located on each tape box.

Figure 8:
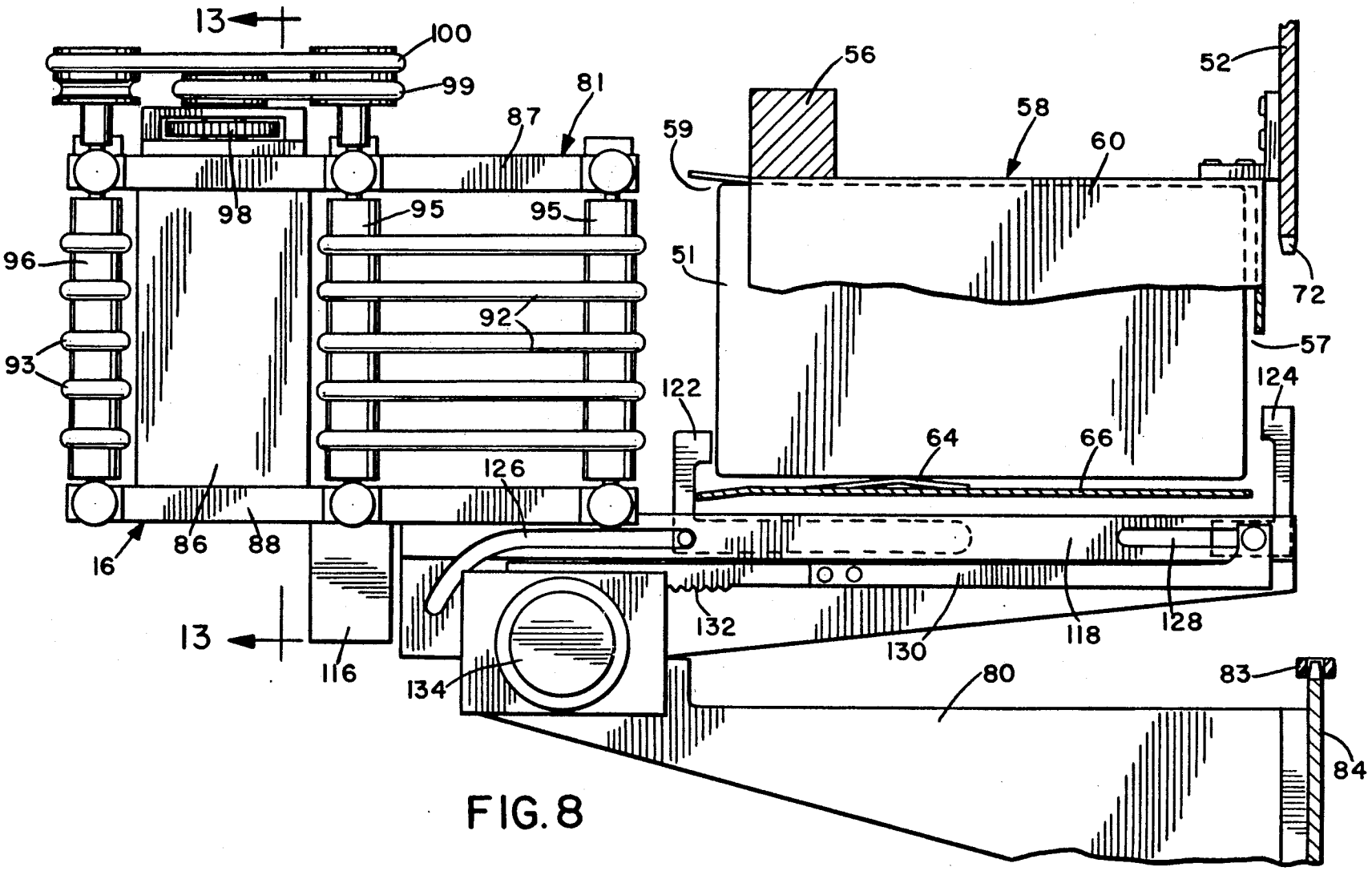
FIG. 8 is an enlarged sectional view taken on line 8—8 of FIG. 5.

FIG. 8 illustrates the picker arm as it will be positioned during rotation across part of the front face of one of the drive wheels. As illustrated in FIGS. 8, 9 and 11, a pair of parallel extension arms 118, 120 project from the rear or inner end of the tape slot towards the rear wall of the housing and across the drum array, so that their inner ends are located on the rear side of the storage drums. Retractable injector and ejector bars 122, 124 are slidably mounted in injector and ejector slots 126, 128 located at opposite ends of extension arm 118. The injector and ejector bars project upwardly from the arms as illustrated in FIG. 8, so that when the picker arm is in the home position of one of the wheels, they will face the outer and inner end faces, respectively, of a tape 51 in the holder then located at that home position.

Ejector slot 128 is straight and is of sufficient length for the ejector bar 124, if driven along the slot, to push a tape 51 far enough out of its holder to be picked up by the conveyer belts 92, as explained in more detail below. The ejector bar 124 is connected via linkage arm 130 to toothed bar or rack 132 linked to a pinion or gear wheel driven by ejector motor 134 mounted on one side of the picker arm framework. Injector slot 126 is curved downwardly at its inner end to allow the injector bar 122 to pivot out of the way into a retracted position, as indicated in dotted outline in FIG. 9, while a tape is being driven into the picker arm slot. The straight portion of the slot is positioned to extend across the inner end of the tape holder slot in the picker arm, and is of sufficient length for the injector bar, if driven to the end of the slot, to push a tape currently being driven out of the retaining slot by the conveyer belts, off the conveyer belts and completely into the aligned tape holder slot at the home position of the selected storage wheel, as illustrated in FIG. 8. The injector bar is connected via link 136 to a similar rack and pinion drive (not shown) driven by injector motor 138 mounted on the opposite side of the pickup arm framework (see FIG. 11).

Operation of the tape transport mechanism can now be described in more detail. All of the various drive motors and the optical position sensors are suitably linked to the computer, as explained in more detail below in connection with FIG. 15, and the computer controls operation of the various motors in accordance with its stored program instructions and inputs at the control panel, as will be explained later.

Consider first the operation of the mechanism to retrieve a selected tape from its storage wheel. The drive motor 74 will be controlled to rotate all four wheels until the particular tape holder containing the selected tape is aligned with the home position for its storage wheel. At the same time, picker drive motor 82 will be controlled to rotate the picker arm so that it is also aligned with the home position of that wheel. The mechanism will be in the position shown in FIG. 8 at this point. Injector bar 122 Will be retracted into the dotted line position shown in FIG. 9. Ejector bar motor 134 will now be actuated to drive the ejector bar along slot 128, pushing the tape out of its holder until its outer end enters the open end of the retainer slot on the picker arm, as indicated in FIG. 9, where it can be picked up by the conveyer belts. At this point, the optical sensor will detect arrival of the tape, and the conveyer belt motor will be turned on so as to drive the belts in a forwards direction to move the tape into the slot. As soon as the optical sensor at the opposite end of the slot detects arrival of the end of the tape at that position, the motor is turned off.

At this point the picker arm motor is again actuated to drive the picker arm into a position aligned with the delivery chute 29, indicated schematically in FIG. 9. The delivery chute is, of course, not aligned with any storage wheel home position but is shown that way in FIG. 9 for clarity. It will be located at an intermediate arcuate position in the travel of the picker arm between two drum home positions. Once the picker arm is aligned with the delivery chute, the conveyer belt motor is again actuated in the same direction to drive the tape out through the slot, as indicated in FIG. 9, where it can be pulled out by a customer.

At the end of each transaction, the picker arm is returned to the delivery position aligned with the delivery chute to await further input.

In order to return a tape, the customer inserts a tape through the delivery chute into the aligned slot in the picker arm. Once the optical sensor 146 in the delivery chute entrance detects the presence of the tape, the conveyer belt motor 97 is driven in the opposite direction to pull the tape into the retaining slot. Once the end of the tape reaches the opposite end of the slot, as detected by the optical sensors on the picker member, the motor is turned off again. The bar code reader 116, which will be of a standard type, will meanwhile read and verify the bar code of the tape. If the tape is verified, the picker arm motor will again be controlled to drive the picker arm to the home position of the appropriate storage wheel on which that tape is normally stored, while the storage wheel drive motor is controlled to drive that storage wheel until the appropriate empty tape holder is aligned with the home position.

At this point the conveyer belt motor will again be actuated to drive the tape out of the picker arm slot and into the tape holder. When the optical sensors indicate that the tape is about to move out of the picker arm slot, the injector arm drive motor 138 is actuated to drive the injector arm 122 along its slot, where it engages the end of the tape and pushes it completely into the aligned holder, as indicated in FIG. 8.

The alignment of the picker arm with the respective storage wheel home positions and the delivery chute may be detected by suitable sensors. However, in the preferred embodiment of the invention the position control is accomplished by suitable calibration of the two stepper motors 74 and 82 controlling rotation of the storage wheels and picker arm. The generous fluted leading surfaces at the front opening of each tape holder minimize the effect of any slight misalignment between the picker arm and drum home position.

The storage wheel and picker arm drive mechanisms have minimal hysteresis in view of the large diameter gear wheels or sprockets which result in an effectively zero backlash drive. Mounting the drive chain on large diameter sprockets also reduces the tensile operating load on the chain and consequently reduces stretch and wear.

All of the motion in the transport mechanism to drive the picker arm and selected tape towards each other is rotary, eliminating the need to convert rotary to linear motion, which inherently results in errors. Also, the maximum distance any tape ever has to travel is one half revolution of the drum or wheel, providing tape access in a relatively short time. The total number and velocity of the moving parts is reduced by the rotary system described. The system has essentially only nine moving parts. The drums can be rotated at less than one-half revolution per minute to provide tape access in under 20 seconds.

The delivery chute may be designed to accept only a specific size of tape box, and is also preferably designed to protect the machine from insertion of foreign objects.

The controller or computer 18 is suitably programmed to control operation of all the transport mechanism motors as explained in more detail below. As mentioned above, each particular videotape title is associated with a predetermined selection code, which will be provided on the front panel of the housing adjacent a film transparency of the artwork for that particular title. One or more copies of that particular videotape will be stored in the housing in tape holder slots on one or more of the drums. Typically, several copies of the more popular titles will be stored in the machine. In the preferred embodiment of the invention, each drum has 50 storage slots around its periphery, allowing the machine to store up to 200 videotapes.

The computer has a memory 140 (indicated schematically in FIG. 15) in which the entire database is maintained. This includes program instructions, a member file of existing customers and their associated member numbers, an open transactions file of current rentals, a closed transactions file, a tape title file of tape titles stored in the machine, a "key to title" file which associates each selection code with a particular tape title, as well as information associating each of the drum slots with the selection code corresponding to the tape normally stored in that slot. Thus, if the four drums are indicated by the letters A, B, C, D, and the drum slots are numbered 1 to 50, the slots A01 to A50, B01 to B50, C01 to C50 and D01 to D50 will be associated with certain selection codes representing the titles stored in those slots.

In addition to the selection code associated with each title, each particular videotape box will have its own specific bar code on one end. Thus, if several copies of a particular videotape title are stored in the machine, each particular copy of that title will have its own specific code represented by the bar code on that videotape box, and will be associated with a specific holder slot on a specific storage drum. Thus the computer memory also contains information associating each storage slot with a specific bar code, and thus with a specific copy of a videotape. This enables the computer to determine whether or not a returned tape actually belongs in that machine, and prevents attempts to return tapes to a slot which is already occupied. The memory is also updated continuously as videotapes are rented and returned, and therefore contains information on the current availability status of each videotape copy.

Figure 15:
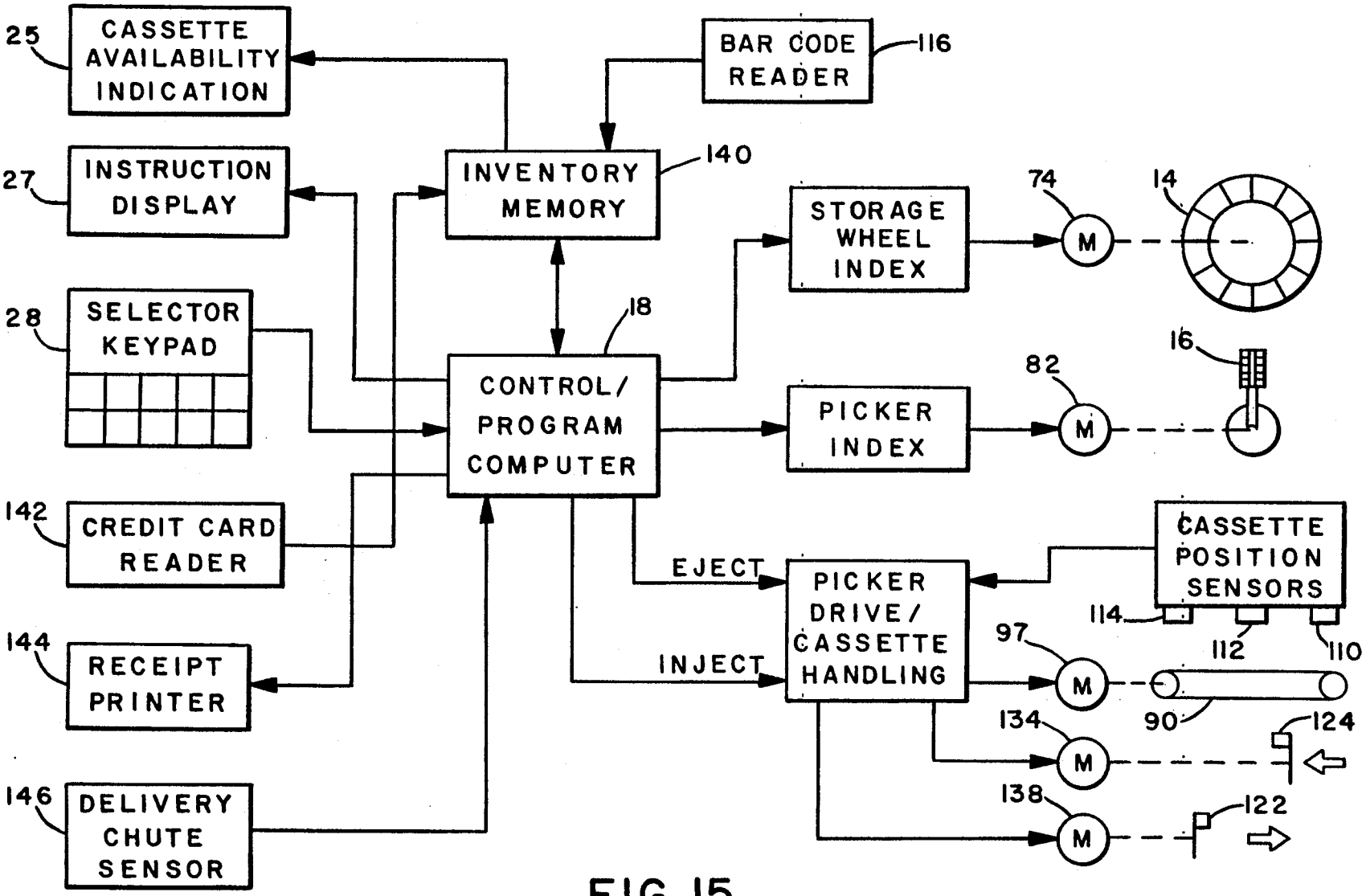
FIG. 15 is a block diagram of the operating system of the machine.

FIG. 15 is a block diagram illustrating the operating system for controlling operation of the various devices. The computer may be of any suitable type, and in one specific embodiment an IBM XT clone running at eight or ten megahertz basic processor clock speed was used. The software for running the system includes a module for controlling the video display screen 27. Another program module is responsive to input from 12 key keypad 28, which is linked to the computer in a known manner via non-standard parallel ports. The keypad is scanned repeatedly for inputs. The computer is also programmed to control activation of the indicator lamps 25 indicating availability of each title in response to the current status of titles stored in the machine, which is updated in the memory 140 as each copy is rented and as previously rented videotapes are returned. Another program module is designed to receive and interpret the output of credit card reader 142 which is attached via a standard serial port Credit card reader 142 may be of any standard type for reading credit cards inserted by customers in slot 30. Such credit card readers include sensors for detecting the presence of a credit card, and may also be arranged to detect and prevent insertion of an improperly orientated card. The machine may also be configured to accept bank debit cards rather than credit cards. The program is configured to interpret the card type, account, expiration date and name from information received from the credit card reader.

The machine is preferably also provided with a receipt printer 144, which is attached to the computer via a standard parallel port LPT1 and delivers printed receipts to customers via receipt slot 32 on the front panel of the machine. Printer 144 is also controlled by the computer as indicated in FIG. 15.

The computer is programmed to store data regarding the current positions of the picker arm and storage wheel, and to control the stepper motors for driving the arm and wheels in response to the stored position information as well as keypad inputs and bar code information. The computer also operates suitable motor controllers for driving conveyer belt motor 97 and the injector and ejector bar motors 138, 134. The tape position sensors 110, 112, 114 are linked to the computer via non-standard parallel ports in a known manner. The additional infrared sensor 146, which is provided at the delivery chute exit to detect the presence of a tape in the chute, is linked to the computer in a similar manner. The bar code reader 116 is attached logically via an IBM standard serial keyboard port and physically via a bus-mounted adapter card The motor controllers include up to five stepper motor controllers daisy-chained on a standard serial port COM3, and several DC motor controllers installed on the PC bus.

A 1200 or 2400 baud modem (not shown) is preferably attached via a standard serial port COM1 to allow the system to communicate periodically with a remote central processing station.

Operation of the system to allow users to rent and return videotapes will now be described in more detail. The program utilized in the preferred embodiment of the invention employs a series of steps, each of which is identified by a serial number and contains specification of which display screen, if any, is to be displayed upon entry to the step. The steps are outlined in Table 1 below. Each step has a number of possible exit vectors, depending on the current state of the machine. In exiting each step, a series of conditions maintained by concurrent system processes is tested for various combinations of conditions to determine the next step to be executed. Each condition may be TRUE, FALSE or INDETERMINATE. The program is therefore of a branching and multi-tasking type in which each step has a series of possible exit branches.

TABLE 1
PROGRAM CONTROL
FLOW CHART

SUMMARY OF PROCESS STEPS: (These steps are referenced by number and more fully described in the process control flow chart which follows.)

1. opening step
2. unrecognized card
3. not member 1 of 3: allow exit.
4. not member 2 of 3: get new PIN.
5. not member 3 of 3: confirm and print info.
6. cancelled member: message, timeout, cancel.
7. get PIN.
8. bad PIN, message; timeout and cancel.
9. rent/return 1 of 2: at tapes out limit?
10. There is no step 10.
11. select tape and check availability.
12. display title, confirm Y/N?
13. deliver tape.
14. must return before renting any more.
15. receive tape, check barcode
16. bad bars label, spit tape.
17. unknown bars, spit tape.
18. put tape away, close trans.
19. maintenance card: run maintenance subsystem.
20. end session: eject card.
21. end session: wait for card and tape removal.
22. cancel session: eject card.
23. cancel session: check tape and card removal.
24. session time allowed expired, eject card.
25. session time allowed expired, check tape & card removal.
26. print receipt? Y/N
27. clean up
28. delivery error
29. store error
30. out of order
31. take card & tape!
32. take card!
33. take tape!
34. non-fatal store error
35. non-fatal delivery error
36. not member 2 of 3: explain membership.
37. remove selection
38. ask: if more tapes to return.
39. return your tape now
40. was tape damaged?
41. tape damaged, issue credit SUMMARY OF DISPLAY SCREEN MESSAGES: (These graphics display images are referenced by number in the process step definitions which follow.)

1. "Welcome to Vu-Tron: insert card or tape."
2. "Unacceptable card. Try again."
3. "Membership explanation."
4. "New PIN entry screen."
5. "Member confirmation screen."
6. "Membership process cancelled."
7. "PIN entry screen."
8. "Bad PIN"
9. "Rent or Return"
10. "Select tape"
11. "Confirm selection"
12. "Getting tape"
13. "You must return a tape to rent more."
14. "Bad Tape Label"
15. "Unknown Tape"
16. "Storing tape..."
17. "End of Session"
18. "Session Cancelled"
19. "Session Timed-Out"
20. "OUT OF ORDER"
21. "Take your card"
22. "Take tape."
23. "Take your card and tape."
24. "Do you want a receipt?"
25. "Prepended non-member screen: yes=become member, no=cancel"
26. "Non-fatal delivery error, tape not available."
27. "Please remove your selection."
28. "Return your tape now."
29. "More tapes to return? YES - return them now, NO, press NO"

SUMMARY DIAGRAM OF VU-TRON "VEND" PROGRAM CONTROL FLOW

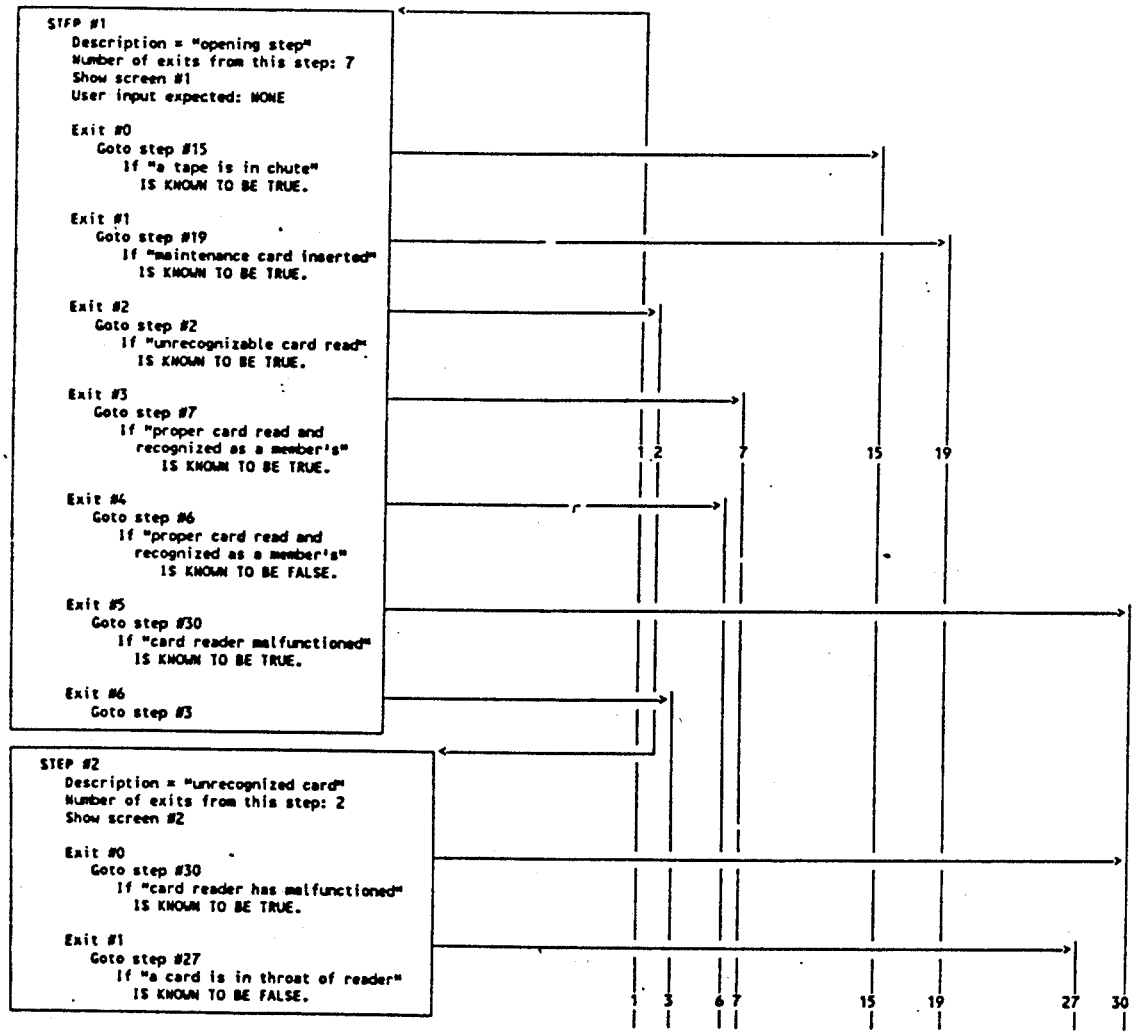

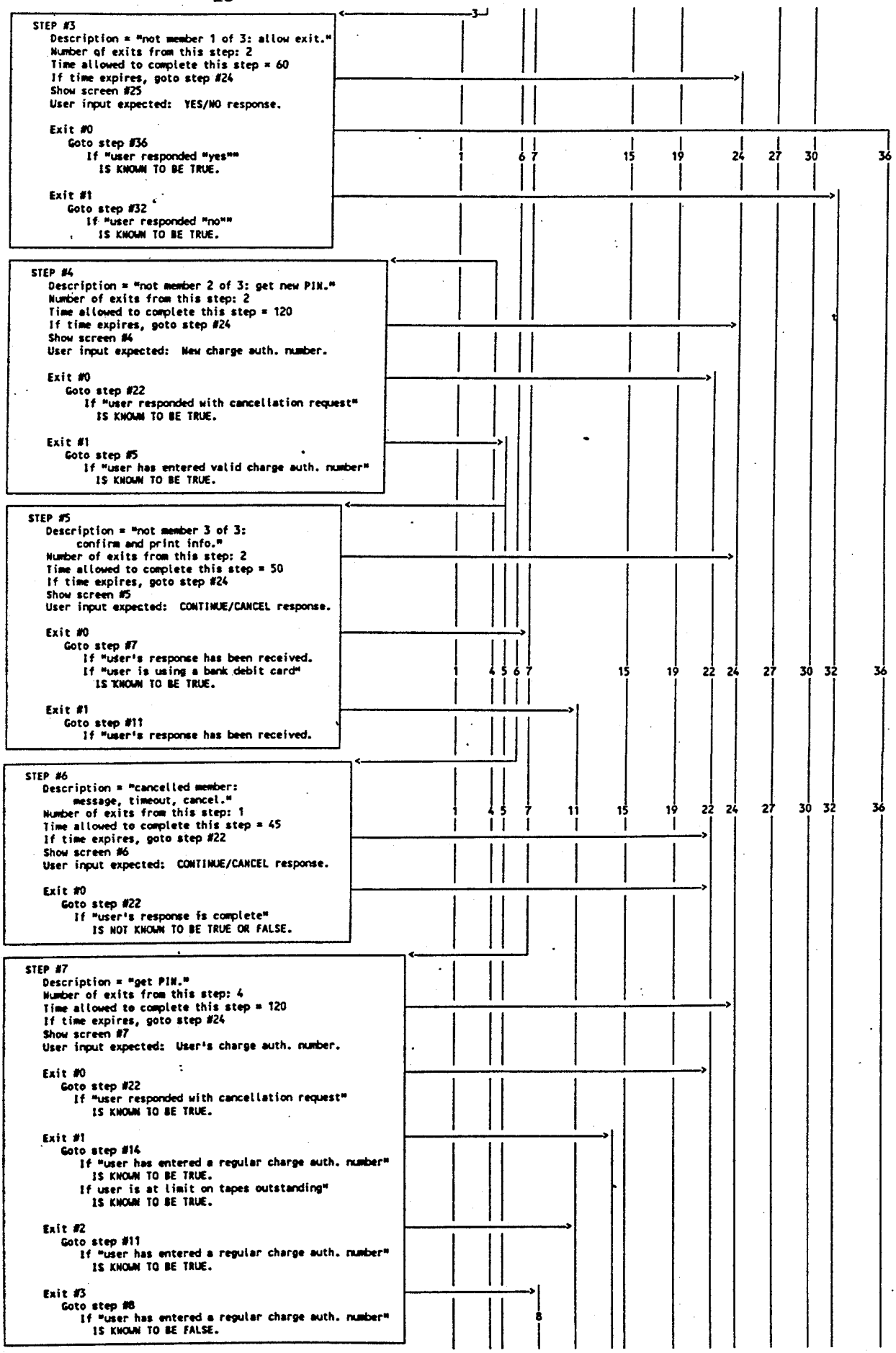
STEP #3
Description = "not member 1 of 3: allow exit."
Number of exits from this step: 2
Time allowed to complete this step = 60
If time expires, goto step #24
Show screen #25
User input expected: YES/NO response.
Exit #0
Goto step #36
If "user responded "yes""
IS KNOWN TO BE TRUE.
Exit #1
Goto step #32
If "user responded "no""
IS KNOWN TO BE TRUE.
STEP #4
Description = "not member 2 of 3: get new PIN."
Number of exits from this step: 2
Time allowed to complete this step = 120
If time expires, goto step #24
Show screen #4
User input expected: New charge auth. number.
Exit #0
Goto step #22
If "user responded with cancellation request"
IS KNOWN TO BE TRUE.
Exit #1
Goto step #5
If "user has entered valid charge auth. number"
IS KNOWN TO BE TRUE.
STEP #5
Description = "not member 3 of 3:
confirm and print info."
Number of exits from this step: 2
Time allowed to complete this step = 50
If time expires, goto step #24
Show screen #5
User input expected: CONTINUE/CANCEL response.
Exit #0
Goto step #7
If "user's response has been received.
If "user is using a bank debit card"
IS KNOWN TO BE TRUE.
Exit #1
Goto step #11
If "user's response has been received.
STEP #6
Description = "cancelled member:
message, timeout, cancel."
Number of exits from this step: 1
Time allowed to complete this step = 45
If time expires, goto step #22
Show screen #6
User input expected: CONTINUE/CANCEL response.
Exit #0
Goto step #22
If "user's response is complete"
IS NOT KNOWN TO BE TRUE OR FALSE.
STEP #7
Description = "get PIN."
Number of exits from this step: 4
Time allowed to complete this step = 120
If time expires, goto step #24
Show screen #7
User input expected: User's charge auth. number.
Exit #0
Goto step #22
If "user responded with cancellation request"
IS KNOWN TO BE TRUE.
Exit #1
Goto step #14
If "user has entered a regular charge auth. number"
IS KNOWN TO BE TRUE.
If user is at limit on tapes outstanding"
IS KNOWN TO BE TRUE.
Exit #2
Goto step #11
If "user has entered a regular charge auth. number"
IS KNOWN TO BE TRUE.
Exit #3
Goto step #8
If "user has entered a regular charge auth. number"
IS KNOWN TO BE FALSE.
3
1 6 7 15 19 24 27 30 36
1 4 5 6 7 15 19 22 24 27 30 32 36
1 4 5 7 11 15 19 22 24 27 30 32 36
8

STEP #8
Description = "bad PIN, message; timeout and cancel."
Number of exits from this step: 0
Time allowed to complete this step = 10
If time expires, goto step #22
Show screen #8

STEP #9
Description = "rent/return 1of2: at limit?"
Number of exits from this step: 2

Exit #0
Goto step #14
If "user is at limit on tapes outstanding" IS KNOWN TO BE TRUE.

Exit #1
Goto step #11

STEP #11
Description = "select tape and check availability."
Number of exits from this step: 4
Time allowed to complete this step = 60
If time expires, goto step #22
Show screen #10
User input expected: Tape selection key number.

Exit #0
Goto step #15
If "a tape is in chute" IS KNOWN TO BE TRUE.

Exit #1
Goto step #12
If "user has responded with a selection key." IS KNOWN TO BE TRUE.
If "user's selection is complete." IS KNOWN TO BE TRUE.
If "user's selection has been found and is available." IS KNOWN TO BE TRUE.

Exit #2
Goto step #20
If "user's response has been received.
If user has rented any tapes in this session of use." IS KNOWN TO BE TRUE.

Exit #3
Goto step #22
If "user's response has been received.

STEP #12
Description = "display title, confirm Y/N?"
Number of exits from this step: 2
Time allowed to complete this step = 20
If time expires, goto step #11
Show screen #11
User input expected: YES/NO response.

Exit #0
Goto step #13
If "user responded "yes""
IS KNOWN TO BE TRUE.

Exit #1
Goto step #11
If "user responded "no""
IS KNOWN TO BE TRUE.

STEP #13
Description = "deliver tape."
Number of exits from this step: 5
Time allowed to complete this step = 30 secs.
If time expires, goto step #28
Show screen #12
User input expected: NONE.

Exit #0
Goto step #37
If "delivery operation is complete"
IS KNOWN TO BE TRUE.
If "a tape is in chute"
IS KNOWN TO BE TRUE.

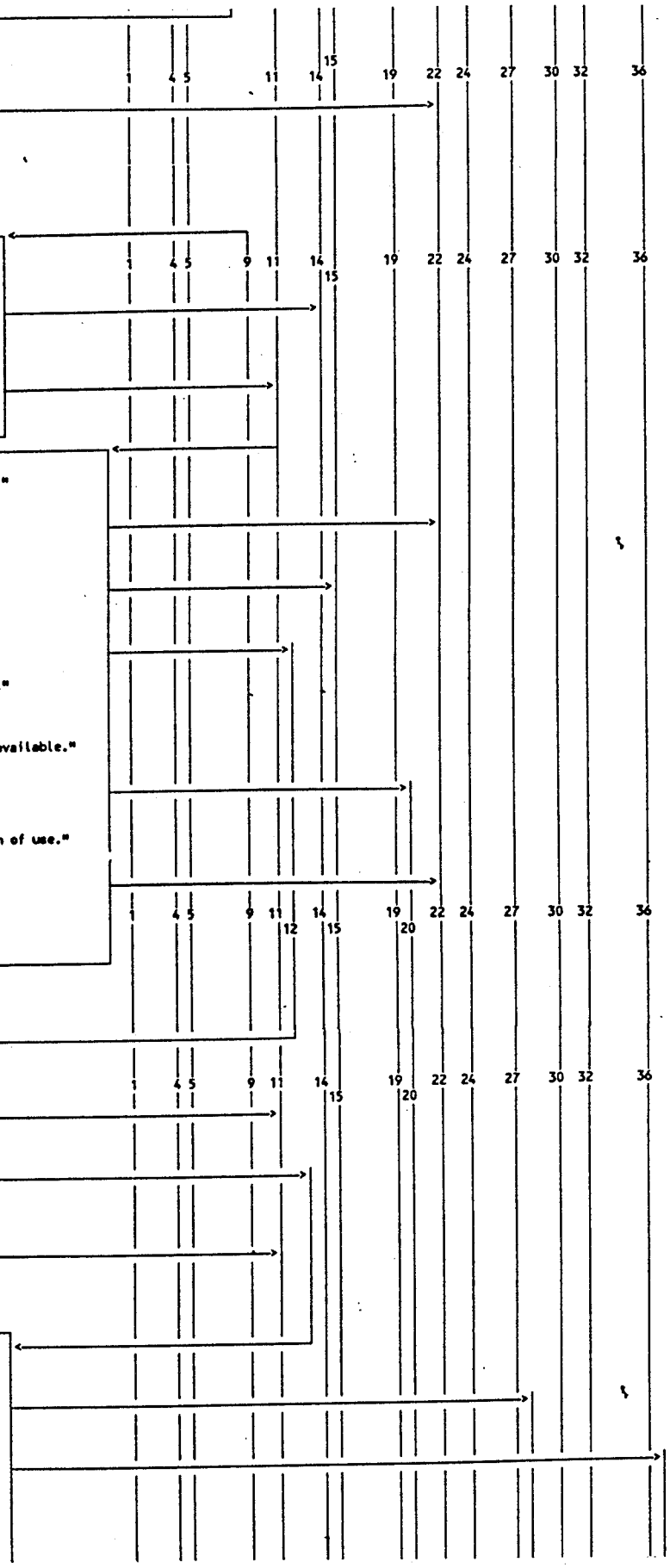

```
Exit #1
   Goto step #11
      If "delivery operation is complete"
        IS KNOWN TO BE TRUE.
      If "user is at limit on tapes outstanding"
        IS KNOWN TO BE FALSE.

Exit #2
   Goto step #14
      If "delivery operation is complete"
        IS KNOWN TO BE TRUE.
      If "user is at limit on tapes outstanding"
        IS KNOWN TO BE TRUE.

Exit #3
   Goto step #28
      If "a fatal hardware failure has occurred"
        IS KNOWN TO BE TRUE.

Exit #4
   Goto step #35
      If "delivery operation is complete"
        IS KNOWN TO BE FALSE.
```

```
STEP #14
   Description = "must return before renting."
   Number of exits from this step: 2
   Time allowed to complete this step = 60
   If time expires, goto step #24
   Show screen #13
   User input expected:
     "Complete and close transaction."

   Exit #0
      Goto step #15
         If "a tape is in chute"
           IS KNOWN TO BE TRUE.

   Exit #1
      Goto step #20
         If "user's response has been received.
```

```
STEP #15
   Description = "receive tape, check barcode"
   Number of exits from this step: 4
   Time allowed to complete this step = 10 seconds
   If time expires, goto step #16

   Exit #0
      /* bad bars */
      Goto step #16
         If "valid barcode has been read"
           IS KNOWN TO BE FALSE.

   Exit #1
      /* store and close trans */
      Goto step #40
         If "barcode read has been found in database."
           IS KNOWN TO BE TRUE.
         If "valid barcode has been read"
           IS KNOWN TO BE TRUE.

   Exit #2
      /* unknown bars */
      Goto step #17
         If "barcode read has been found in database."
           IS KNOWN TO BE FALSE.
         If "valid barcode has been read"
           IS KNOWN TO BE TRUE.

   Exit #3
      /* no tape received in picker - return to step 1 */
      Goto step #16
         If "valid barcode has been read"
           IS NOT KNOWN TO BE TRUE OR FALSE.
```

```
STEP #16
   Description = "bad bars label, spit tape."
   Number of exits from this step: 3
   Time allowed to complete this step = 5
   Show screen #14
   User input expected:  CONTINUE/CANCEL response.

   Exit #0
      Goto step #9
         If "user's response has been received.
         If "proper card read and
           recognized as a member's"
              IS KNOWN TO BE TRUE.

   Exit #1
      Goto step #38
         If "user's response has been received.

   Exit #2
      Goto step #38
         If "time allowed for step has expired."
           IS KNOWN TO BE TRUE.
```

```
STEP #17
   Description = "unknown bars, spit tape."
   Number of exits from this step: 3
   Time allowed to complete this step = 5
   Show screen #15
   User input expected:  CONTINUE/CANCEL response.
```

```
Exit #0
   Goto step #9
      If "user's response has been received.
      If "proper card read
        and recognized as a member's"
          IS KNOWN TO BE TRUE.

Exit #1
   Goto step #38
      If "user's response has been received.

Exit #2
   Goto step #38
      If "time allowed for step has expired."
        IS KNOWN TO BE TRUE.
```

```
STEP #18
   Description = "put tape away, close trans."
   Number of exits from this step: 6
   Time allowed to complete this step = 30 seconds
   If time expires, goto step #29
   Show screen #16

   Exit #0
      Goto step #9
         If "proper card read
           and recognized as a member's"
             IS KNOWN TO BE TRUE.
         If "tape storage operation is complete"
           IS KNOWN TO BE TRUE.

   Exit #1
      Goto step #38
         If "user has more tapes out from prior rentals"
           IS KNOWN TO BE TRUE.
         If "tape storage operation is complete"
           IS KNOWN TO BE TRUE.

   Exit #2
      Goto step #26
         If "receipt information has been accumulated"
           IS KNOWN TO BE TRUE.
         If "tape storage operation is complete"
           IS KNOWN TO BE TRUE.

   Exit #3
      Goto step #27
         If "tape storage operation is complete"
           IS KNOWN TO BE TRUE.

   Exit #4
      Goto step #29
         If "a fatal hardware failure has occurred"
           IS KNOWN TO BE TRUE.

   Exit #5
      Goto step #34
         If "tape storage operation is complete"
           IS KNOWN TO BE FALSE.
```

```
STEP #19
   Description = "maintenance card:
     run maintenance subsystem."
   Number of exits from this step: 1

   Exit #0
      Goto step #27
```

```
STEP #20
   Description = "end session: eject card."
   Number of exits from this step: 2

   Exit #0
      Goto step #26
         If "receipt information is pending"
           IS KNOWN TO BE TRUE.

   Exit #1
      Goto step #21
```

```
STEP #21
   Description = "end session:
     wait for card and tape removal."
   Number of exits from this step: 5
   Time allowed to complete this step = 5
   Show screen #17

   Exit #0
      Goto step #30
         If "card reader has malfunctioned"
           IS KNOWN TO BE TRUE.

   Exit #1
      Goto step #31
         If "time allowed for step has expired."
           IS KNOWN TO BE TRUE.
         If "a card is in throat of reader"
           IS KNOWN TO BE TRUE.
         If "a tape is in chute"
           IS KNOWN TO BE TRUE.

   Exit #2
      Goto step #32
         If "time allowed for step has expired."
           IS KNOWN TO BE TRUE.
         If "a card is in throat of reader"
           IS KNOWN TO BE TRUE.

   Exit #3
      Goto step #33
         If "time allowed for step has expired."
           IS KNOWN TO BE TRUE.
         If "a tape is in chute"
           IS KNOWN TO BE TRUE.

   Exit #4
      Goto step #27
```

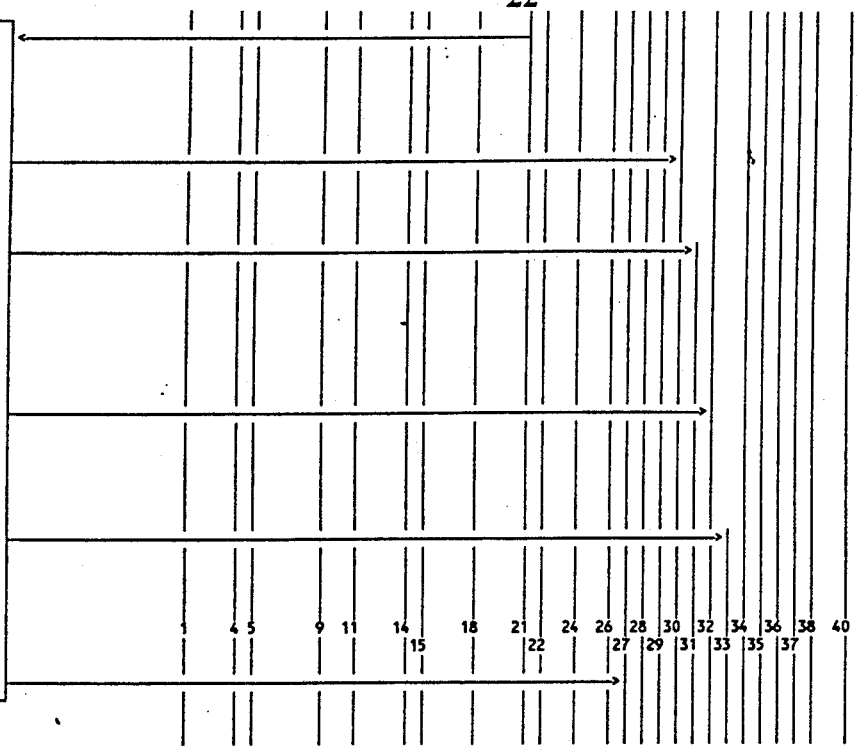

```
STEP #22
   Description = "cancel session:
     eject card"
   Number of exits from this step: 2

   Exit #0
      Goto step #26
         If "receipt information is pending"
           IS KNOWN TO BE TRUE.

   Exit #1
      Goto step #23
```

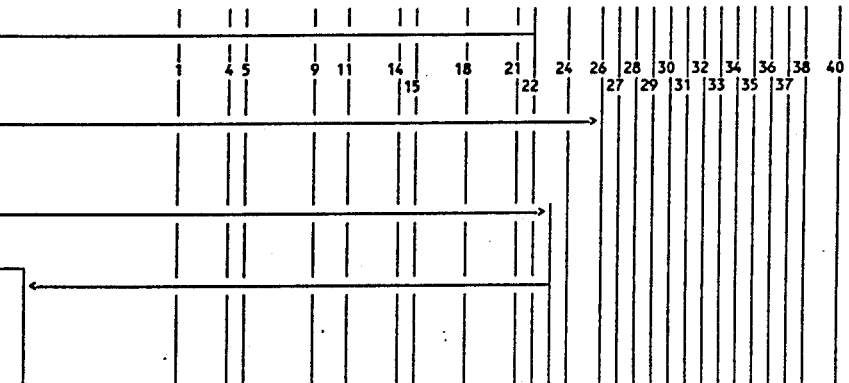

```
STEP #23
   Description = "cancel session:
     check tape and card."
   Number of exits from this step: 5
   Time allowed to complete this step = 5
   Show screen #18

   Exit #0
      Goto step #30
         If "card reader has malfunctioned"
           IS KNOWN TO BE TRUE.
         If "time allowed for step has expired."
           IS KNOWN TO BE TRUE.

   Exit #1
      Goto step #31
         If "time allowed for step has expired."
           IS KNOWN TO BE TRUE.
         If "a card is in throat of reader"
           IS KNOWN TO BE TRUE.
         If "a tape is in chute"
           IS KNOWN TO BE TRUE.

   Exit #2
      Goto step #32
         If "time allowed for step has expired."
           IS KNOWN TO BE TRUE.
         If "a card is in throat of reader"
           IS KNOWN TO BE TRUE.

   Exit #3
      Goto step #33
         If "time allowed for step has expired."
           IS KNOWN TO BE TRUE.
         If "a tape is in chute"
           IS KNOWN TO BE TRUE.

   Exit #4
      Goto step #27
         If "time allowed for step has expired."
           IS KNOWN TO BE TRUE.
```

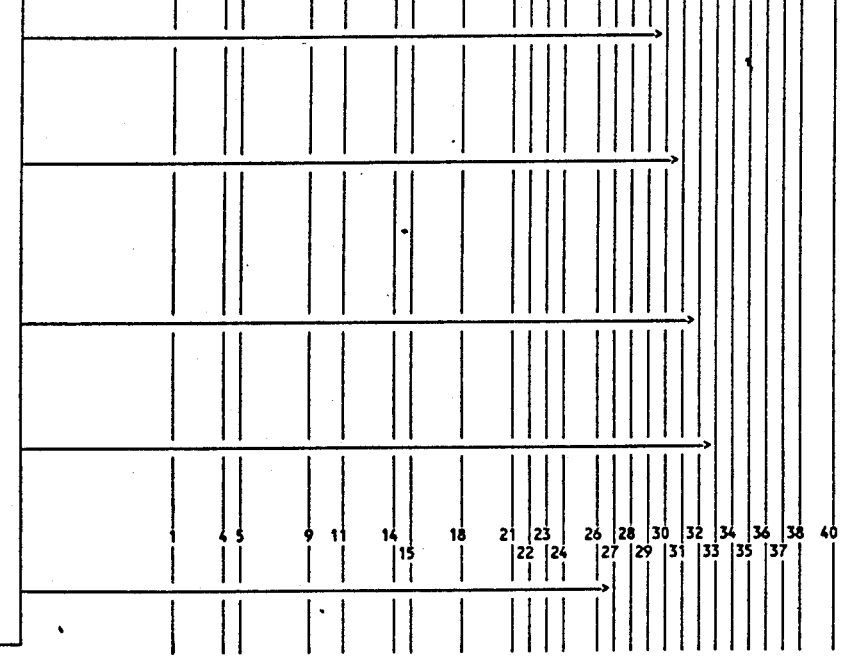

```
STEP #24
   Description = "session time allowed
     for step has expired.: eject card."
   Number of exits from this step: 2
   Time allowed to complete this step = 5
   Show screen #19

   Exit #0
      Goto step #26
         If "receipt information is pending"
           IS KNOWN TO BE TRUE.
         If "time allowed for step has expired."
           IS KNOWN TO BE TRUE.

   Exit #1
      Goto step #25
         If "time allowed for step has expired."
           IS KNOWN TO BE TRUE.
```

```
STEP #25
   Description = "session time allowed
     for step has expired.: check tape & card."
   Number of exits from this step: 5
   Time allowed to complete this step = 1

   Exit #0
      Goto step #30
         If "card reader has malfunctioned"
           IS KNOWN TO BE TRUE.

   Exit #1
      Goto step #31
         If "time allowed for step has expired."
           IS KNOWN TO BE TRUE.
         If "a card is in throat of reader"
           IS KNOWN TO BE TRUE.
         If "a tape is in chute"
           IS KNOWN TO BE TRUE.
   Exit #2
      Goto step #32
         If "time allowed for step has expired."
           IS KNOWN TO BE TRUE.
         If "a card is in throat of reader"
           IS KNOWN TO BE TRUE.

   Exit #3
      Goto step #33
         If "time allowed for step has expired."
           IS KNOWN TO BE TRUE.
         If "a tape is in chute"
           IS KNOWN TO BE TRUE.

   Exit #4
      Goto step #27
         If "time allowed for step has expired."
           IS KNOWN TO BE TRUE.
```

```
STEP #26
   Description = "print receipt? Y/N"
   Number of exits from this step: 4
   Time allowed to complete this step = 5
   Show screen #24
   User input expected:  YES/NO response.
   Exit #0
      Goto step #21
         If "session is bound for completion"
           IS KNOWN TO BE TRUE.

   Exit #1
      Goto step #23
         If "session is bound for cancellation"
           IS KNOWN TO BE TRUE.

   Exit #2
      Goto step #25
         If "time allowed for step has expired."
           IS KNOWN TO BE TRUE.

   Exit #3
      Goto step #27
         If "user's response has been received.
```

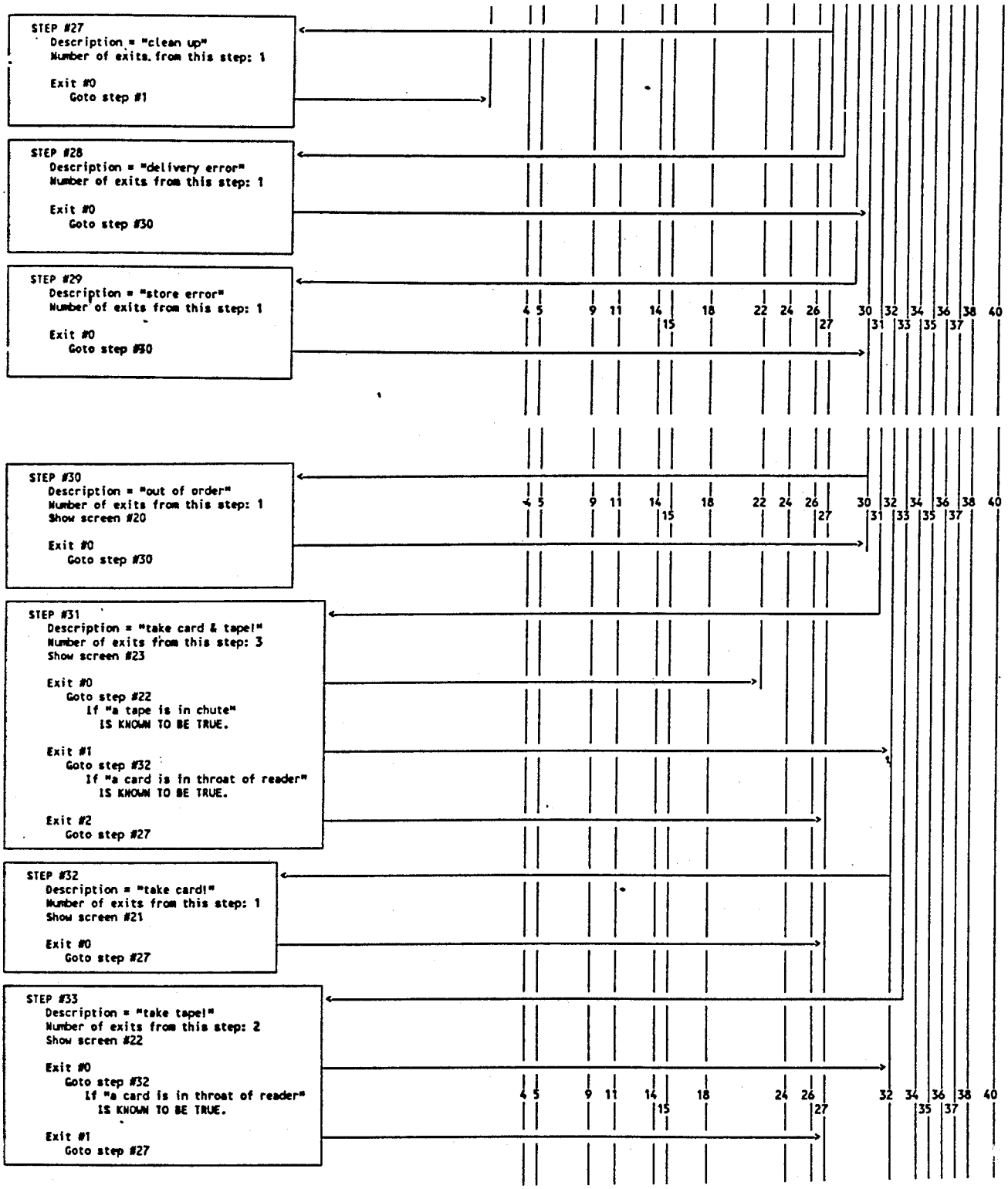
STEP #27
Description = "clean up"
Number of exits from this step: 1
Exit #0
Goto step #1
STEP #28
Description = "delivery error"
Number of exits from this step: 1
Exit #0
Goto step #30
STEP #29
Description = "store error"
Number of exits from this step: 1
Exit #0
Goto step #30
STEP #30
Description = "out of order"
Number of exits from this step: 1
Show screen #20
Exit #0
Goto step #30
STEP #31
Description = "take card & tape!"
Number of exits from this step: 3
Show screen #23
Exit #0
Goto step #22
If "a tape is in chute"
IS KNOWN TO BE TRUE.
Exit #1
Goto step #32
If "a card is in throat of reader"
IS KNOWN TO BE TRUE.
Exit #2
Goto step #27
STEP #32
Description = "take card!"
Number of exits from this step: 1
Show screen #21
Exit #0
Goto step #27
STEP #33
Description = "take tape!"
Number of exits from this step: 2
Show screen #22
Exit #0
Goto step #32
If "a card is in throat of reader"
IS KNOWN TO BE TRUE.
Exit #1
Goto step #27
4 5 9 11 14 15 18 22 24 26 27 30 31 32 33 34 35 36 37 38 40

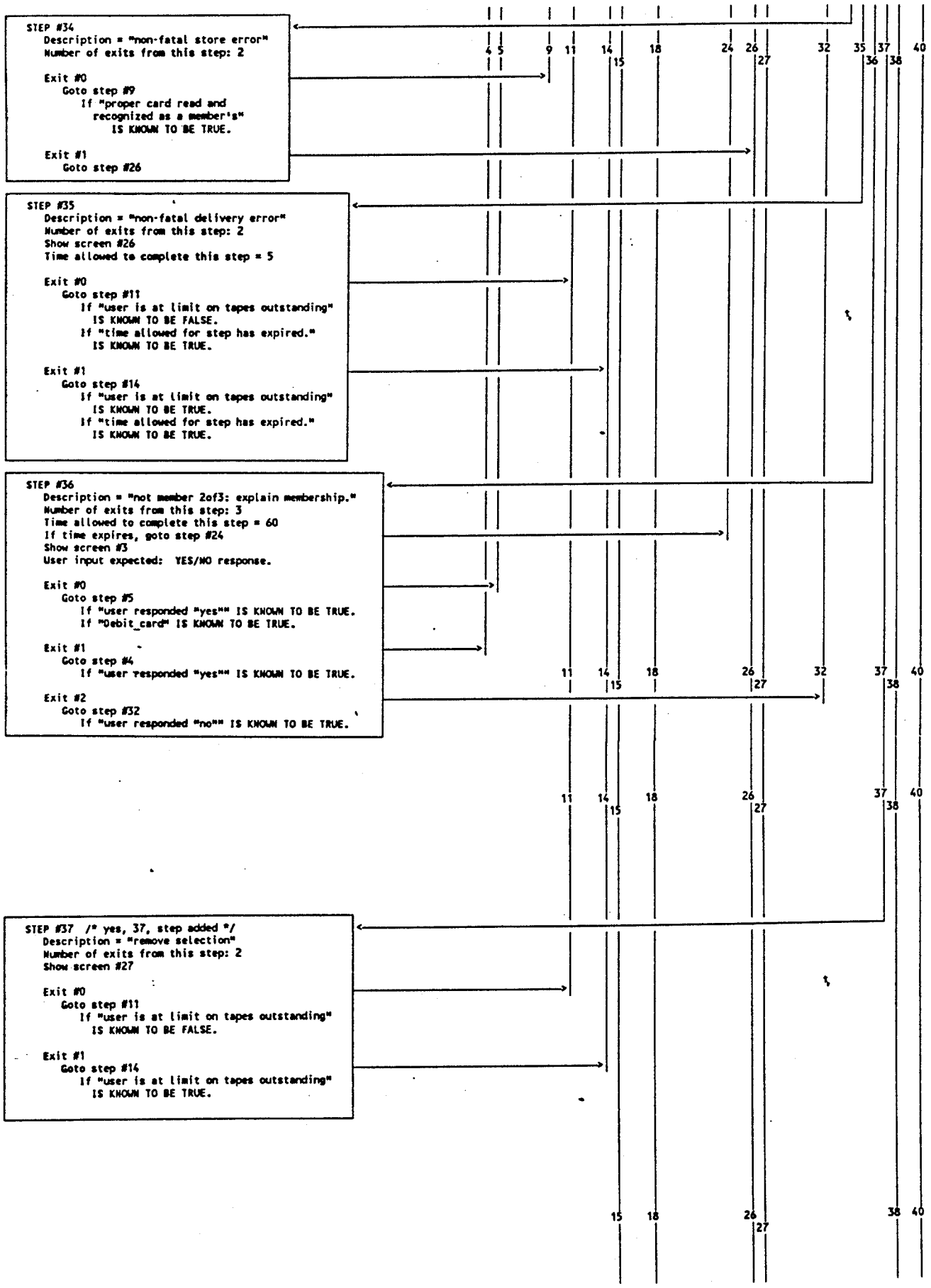
STEP #34
Description = "non-fatal store error"
Number of exits from this step: 2
Exit #0
Goto step #9
If "proper card read and recognized as a member's" IS KNOWN TO BE TRUE.
Exit #1
Goto step #26
STEP #35
Description = "non-fatal delivery error"
Number of exits from this step: 2
Show screen #26
Time allowed to complete this step = 5
Exit #0
Goto step #11
If "user is at limit on tapes outstanding" IS KNOWN TO BE FALSE.
If "time allowed for step has expired." IS KNOWN TO BE TRUE.
Exit #1
Goto step #14
If "user is at limit on tapes outstanding" IS KNOWN TO BE TRUE.
If "time allowed for step has expired." IS KNOWN TO BE TRUE.
STEP #36
Description = "not member 2of3: explain membership."
Number of exits from this step: 3
Time allowed to complete this step = 60
If time expires, goto step #24
Show screen #3
User input expected: YES/NO response.
Exit #0
Goto step #5
If "user responded "yes"" IS KNOWN TO BE TRUE.
If "Debit_card" IS KNOWN TO BE TRUE.
Exit #1
Goto step #4
If "user responded "yes"" IS KNOWN TO BE TRUE.
Exit #2
Goto step #32
If "user responded "no"" IS KNOWN TO BE TRUE.
STEP #37 /* yes, 37, step added */
Description = "remove selection"
Number of exits from this step: 2
Show screen #27
Exit #0
Goto step #11
If "user is at limit on tapes outstanding" IS KNOWN TO BE FALSE.
Exit #1
Goto step #14
If "user is at limit on tapes outstanding" IS KNOWN TO BE TRUE.
4 5 9 11 14 15 18 24 26 27 32 35 36 37 38 40
11 14 15 18 26 27 32 37 38 40
11 14 15 18 26 27 37 38 40
15 18 26 27 38 40

```
STEP #38
  Description = "ask:
     if more tapes to return"
  Number of exits from this step: 7
  Show screen #29
  Time allowed to complete this step = 7
  User input expected:  YES/NO response.

  Exit #0
     Goto step #15
        If a tape is in chute"
           IS KNOWN TO BE TRUE.

  Exit #1
     Goto step #39
        If user responded "yes""
           IS KNOWN TO BE TRUE.

  Exit #2
     Goto step #26
        If user responded "no""
           IS KNOWN TO BE TRUE.
        If "receipt information has been accumulated"
           IS KNOWN TO BE TRUE.

  Exit #3
     Goto step #27
        If user responded "no"" IS KNOWN TO BE TRUE.

  Exit #4
     Goto step #39
        If "user responded "yes""
           IS KNOWN TO BE TRUE.

  Exit #5
     Goto step #26
        If "time allowed for step has expired."
           IS KNOWN TO BE TRUE.
        If "receipt information has been accumulated"
           IS KNOWN TO BE TRUE.

  Exit #6
     Goto step #27
        If "time allowed for step has expired."
           IS KNOWN TO BE TRUE.
```

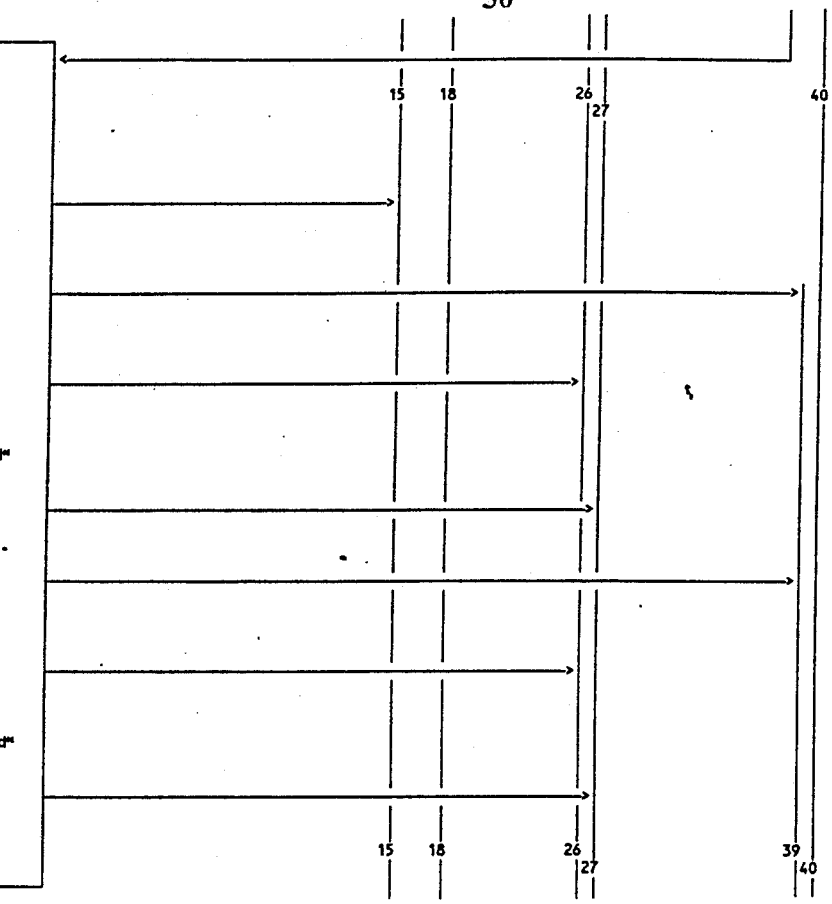

```
STEP #39
   Description = "return your tape now"
   Number of exits from this step: 3
   Show screen #28
   Time allowed to complete this step = 7

   Exit #0
      Goto step #15
         If "a tape is in chute"
            IS KNOWN TO BE TRUE.

   Exit #1
      Goto step #26
         If "receipt information is pending"
            IS KNOWN TO BE TRUE.
         If "time allowed for step has expired."
            IS KNOWN TO BE TRUE.

   Exit #2
      Goto step #27
         If "time allowed for step has expired."
            IS KNOWN TO BE TRUE.
```

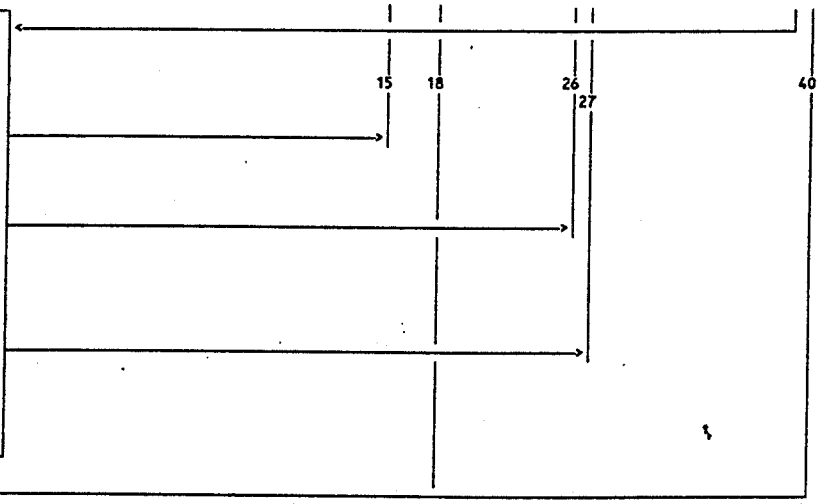

```
STEP #40
   Description = "was tape damaged?"
   Show screen #30
   Number of exits from this step: 2
   Time allowed to complete this step = 5
   If time expires, goto step #18
   User input expected:  YES/NO response.

   Exit #0
      /* no damage */
      Goto step #18
         If "user responded 'no'"
            IS KNOWN TO BE TRUE.

   Exit #1
      /* tape damaged */
      Goto step #41
         If "user responded "yes""
            IS KNOWN TO BE TRUE.
```

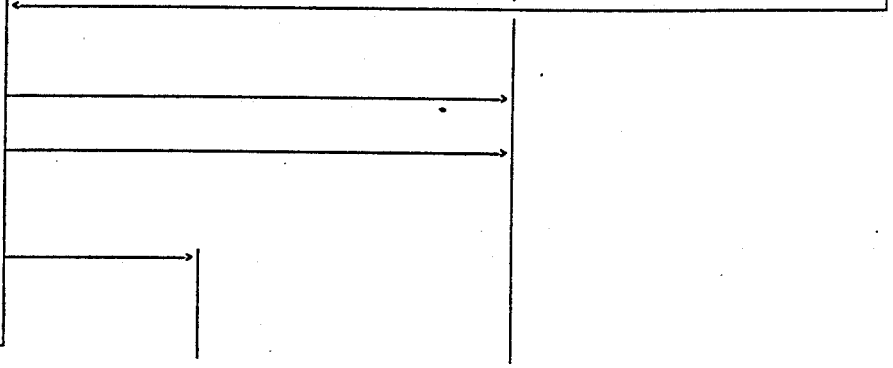

```
STEP #41
   Description = "damaged, issue credit"
   Show screen #31
   Number of exits from this step: 1
   Time allowed to complete this step = 3
   Show screen #31

   Exit #0
      Goto step #18
         If "timeout" IS KNOWN TO BE TRUE.
```

18

With this system, when a customer approaches the machine in order to rent a videotape, they will immediately be able to select a title by viewing the pictorial display and by checking the availability indicator lights to determine whether or not that title is available. At the same time, the customer will ascertain the proper selection code for selecting the chosen title, which is located immediately adjacent the pictorial display for that title.

Several customers may concurrently review and select titles while one customer is actually renting or returning tapes.

The program outlined in Table 1 allows users to insert a credit card, receive an indication of the titles currently available, select a tape to rent, or return a previously rented tape. Tapes may not be rented without insertion of a valid credit card, but returns do not require a card. The user simply inserts the tape into the chute, as explained in more detail below, and the transaction is closed. In each of the steps, the computer checks the possible exit conditions in the order listed and takes the first exit where the conditions are met.

When a user inserts a credit card, a check is performed to determine whether or not they are an existing member. Membership information is stored in the database. Each member has a personal four digit code (PIN or charge authorization number) associated with their credit card information in the database, which they must enter to initiate a rental transaction. Each customer also has a personal maximum number of tapes which they may have on rental at any time. Prior to initiation of any transaction, the system awaits an input (Step 1). If the input is entry of a credit card, and the card is read and recognized to be an existing member whose card has not expired, the customer is asked to enter their PIN number (Step 7). If a valid charge number is entered, and it is determined that the customer does not currently have up to their allocated limit of tapes outstanding, they are asked to enter the selection code for the tape they wish to rent (Step 11), or to return a previously rented tape.

If the credit card read does not belong to an existing member (Step 3), the customer is asked whether or not they wish to become a member and to agree to the terms of machine usage and charges. If the answer is "yes", they are asked to input a four digit personal charge authorization or PIN number (Steps 36, 4, 5), and are then asked to enter the selection code of the chosen title (Step 11).

For both new and old members, once past the sign-on stage of defining or supplying a charge authorization number, the user is allowed to select a tape for rental provided that the user's currently outstanding tapes do not number greater than a software-selectable limit. If the user has the maximum number of tapes allowed outstanding, then the user is prompted to insert a tape for return or end the session of use (Step 14). This same check for maximum allowed tapes outstanding is performed each time the user is about to be presented with the opportunity to select a tape. When presented with the opportunity to select a tape, the user may enter a three digit code found next to a title displayed on the front of the machine, may return a tape, or may end the session of use. If a tape rented against another card is returned at this time, it is properly accounted for the user who rented it, not the user who is presently using the machine. Upon entering a title selection number, the title selected is checked for availability against the inventory stored in the memory. If the title is available (Exit 1 of Step 11), the title is displayed and the user is asked to confirm that this is the title desired (Step 12). If the user responds by confirming, then the tape is dispensed to the user.

If the title is unavailable, the conditions for Exit 1 of Step 11 will not be met and the system will go to either Exit 2 (if the user has rented tapes in the session) or Exit 3 (if no tapes have been rented). The user will be told the title is unavailable, and will be returned to the opportunity to rent or return a tape, via either Step 20 or Step 22.

In order to dispense a selected tape, the computer controls the transport mechanism to drive the picker arm to the home position of the drum on which the selected tape is located, and to drive all four drums until the slot containing that tape is at the home position, as explained above in connection with FIGS. 3 to 15. The picker arm retrieves the tape, is driven to the delivery chute, and ejects the tape into the chute, as was explained above.

Once the delivery operation (Step 13) is complete, if the customer is not at the limit on rented tapes, they are given an opportunity to rent additional titles in the same manner. If the customer is at the limit of rented tapes, they are asked to either return a tape or choose the transaction at this point (Step 14). If the customer ends the transaction, the computer waits for the card and tape to be removed from the chute (Step 21). If either a card or a tape, or both, are still detected after expiry of the allowed time, via sensors in the card reader and delivery chute, various messages are displayed on the screen and audio beeps emitted (Steps 31 to 33). After ending the transaction, the user is asked if a receipt describing all rentals and returns is desired (Step 26). If the user responds positively, a receipt is printed. Once a transaction is complete, the system returns to Step 1 to await further instructions.

In order to return a rented tape, the customer simply inserts the tape into the chute. The presence of a tape is detected by the infrared sensors provided in the delivery chute (Step 1, Exit 0). If a tape is being returned (Steps 1, 11, 38 or 39), the computer controls the picker arm conveyer belts to drive the tape into the pickup slot, and the bar code on the tape is read (Step #15). If no valid bar code can be read, the customer is informed by a suitable display screen, and the tape is ejected (Step 16). If a bar code can be read, the memory is checked to determine whether or not that particular tape is in the machine inventory or database. Optimally, the customer is asked whether or not the tape was damaged (Step 40). If the response is negative, the computer controls the transport mechanism to return the tape to its allotted position on one of the storage drums, which has previously been determined from information stored in the memory. Once the storage operation is complete, a cleanup of data is made (Step 27). At this point, the system returns to Step 1 to await further input.

If the machine is so configured and if the customer indicates the tape was damaged, they are issued a credit (Step 41), and the system follows the same subsequent route as for return of an undamaged tape. However, the inventory is updated to mark the tape unavailable.

If the bar code read on a returned tape cannot be found in the database (for example, where a customer attempts to return a tape to the wrong machine), the tape is ejected (Step 17).

If the customer has more tapes outstanding, the customer is then asked if they wish to return another at this time (Step 38). If the response is "yes", they are asked to return the tape (Step 39). The customer may also simply return another without responding to the question. If a tape is inserted in the chute when the system is at Step 38 or 39, the sequence for receiving a returned tape, starting at Step 15, as explained above, is initiated. If the customer response at Step 38 was "no", a cleanup is performed, and the machine awaits further transactions.

At various stages in the procedure, the memory or database will be updated to maintain the records of currently available tapes, current transactions, and current members. For example, on successful delivery of a tape to a customer, the transaction and tape records will be updated accordingly. If the tape rented is the last copy of a particular title, the indicator light or lights corresponding to that title on the front panel will also be controlled to reflect its unavailability. Once a copy of that title is returned to the machine, the records will be updated and the light or lights will change state to reflect the current availability of that title. The database update is a continuous process which occurs automatically each time a step involving a change in any of the three variables (tapes, transactions, members) is successfully completed.

Optionally, a record may be made each time a user returns a tape damaged, and a record of the prior user renting the same tape is made. The system may be configured to place a limit on the number of damaged returns by a user and to seek users who have frequently rented a tape which is later rented by another user and returned damaged. Optionally, a user's card may be voided for use at the particular site if too many damages are associated with that user.

Closed rental transactions and those out over a specified period of days are reported to a remote host system via dial-up modem. The system may be configured to share a phone line for this purpose, or may have a phone line dedicated for its use. If the phone line is shared, it is programmed from the remote host to attempt to call at predetermined times. At those times, the machine makes noises to alert people to free the phone line and then attempts to call the host system. If the system is unsuccessful, it may attempt to call at predetermined fall-back times. The system is capable of maintaining at least a week's worth of transactions before obtaining contact with the host system. However, communication would normally be made each night during a period of day when customer activity is unlikely. If the system is unable to reach the host for a specified number of days, it goes out of service until it can successfully achieve communication with the remote host system. The system may optionally obtain credit authorizations on transactions at regular or random intervals. Additionally, if a dedicated line is available, the system may be configured to use bank debit cards and post the debits at the time of rental returns.

Charges for unreturned rentals are not made by the onsite system. Such transactions are reported to the host system, and the host system generates such charges. The host system is designed to accumulate all charges from several vending systems and communicate them to a bank via B3780 dial-up communications link.

The vending system has an optional capacity to handle rental of unadvertised titles (typically adult subject matter). If this option is installed, any new user of the system is asked if he or she wants access to such titles. If the user answers affirmatively, they will be informed of a special title identification number (typically 999) to use to view on the display the titles from this category currently available. When so displayed, the user may select to rent one of these tapes. Typically, there is no display for such tapes on the front of the machine. The titles may be displayed with descriptions. Users who have not selected this capability on the first use of their card are not allowed to see this display of available titles or to select one of these titles to rent.

If a tape is returned within a specified quick return interval, there is no charge for the rental. If a tape is not returned within a specified period (typically seven days) and the machine has been restocked with another tape to replace the outstanding tape, the outstanding tape will not be accepted when returned—it is considered the property of the renter and the host system will have charged the renter's account for the purchase of the tape. In the rare event that the host system has charged a user for purchase of a tape and the tape is later returned and accepted, the host system is programmed to issue a credit to the user's account reversing the purchase charge.

The program used to control the system according to the steps outlined in Table 1 is of a specialized nature in the preferred embodiment of the invention. The primary features desired of the software are reliability, ease of alteration, ease of maintenance and efficiency. To achieve these, a linguistic approach was taken to overall control of the program. Most elements of the program combine to offer the facilities of a specialized programming language for controlling this and similar types of machines.

The script or program is built of steps which are compiled into the program as static data structures. Each step ends with a series of exit vectors. Each exit vector contains a bit map representing a state of the machine. If this bit map matches the current state of the system, the script step exits to a specified subsequent step associated with the bit map, as indicated in Table . In addition, each exit vector contains an optional display screen to be displayed upon exit via that vector and a delay period to be invoked upon exit. Each step involving user input is associated with a predetermined time period for completion of that step, after which the system moves to a predetermined subsequent step (see Step 25 in Table 1). In the preferred embodiment of the invention, other than the exit vectors associated with each step of the script, there are no flow control capabilities in the script language. Upon the beginning of each step, the specified display screen, if any, for that step is displayed. This step potentially contains a statement or statements in the 'C' programming language for each step. This statement series may be arbitrarily complex and may use any portion of the software capabilities offered by the various subsystems. By using this approach, we achieve a hybrid interpreted language. The determination of control flow is by language interpretation, but the actions of each step other than option initial and exit display screens is defined in compiled 'C' with its inherent speed and flexibility.

Since the successor to each script step is determined by matching a bit map against the current system state, a state structure describing all relevant aspects of the machine's state is maintained in static memory. This state structure is comprised of "flags" and "values". Each flag may take one of four values: SET, UNSET, RESET or ERROR. The ERROR state should never be experienced but is used to test for memory corruption problems. If a flag is UNSET, the meaning is that the current value of the subject attribute of the system state is unknown. If RESET, the flag is taken to mean OFF or FALSE or ERROR as appropriate in context. If SET, the flag is taken to mean ON, ACTIVE or TRUE as appropriate. The UNSET state is particularly important. If, for example, the flag indicating a bar code has been read is UNSET, this means that a bar code has not yet been read. If it is RESET, this indicates a bar code of improper format has been read or there has been an error in the bar code reader hardware. If the flag is SET, it indicates a valid bar code has been read and is currently stored as a value in the system state structure.

Provision may be made to save and restore system states. When a script step begins, a timer is reset to zero. The step specification may optionally contain a time-out value for this timer and a step to move to should this value be reached.

Within the system state are pointers to the currently active member, tape and transaction as represented in the database. It is through these pointers that the subsystems of the program manipulate or use data. The system state structure is asynchronously updated by the various subsystems, some responding to real-time events and others invoked by the script to perform processing.

The program employs a nonpreemptive multi-tasking technique. The dispatching and control of process is not known to the operating system, but is entirely internal. The currently running process cannot be interrupted by any external process except hardware interrupts. A process only gives up control explicitly by calling a function named "pause". Calling pause may or may not cause the calling process to be interrupted. Interruption will occur if and only if a process of equal or higher priority is in a state ready to run. Processes may block themselves from running until a specified time has elapsed, or until a particular hardware condition has changed. In each case other than blocking for a specific time, the process polls the awaited condition and immediately pauses to other processes if the poll is unsuccessful.

Each non-interrupt process is allocated a separate stack. Interrupt service routines normally use the current stack at the time of interrupt invocation. The original system stack is only used upon initialization and exit.

Some processes are tied to hardware interrupts. These are primarily used to process communications events and to operate a series of timers and delay counters invoked by the system clock interrupt. In some cases, they are used to respond to a switch or sensor event. All hardware interrupt service routines are designed to execute and exit quickly upon occurrence of the relevant event.

The fundamental functions used for multi-tasking support are from a commercial library sold as "Multi-C" from Cytek of Boston.

In addition to the script language employed to manage the control flow of the vending machine's operation software, another language is interpreted by the machine to determine price, discounts, fees and charges. Called "vlisp", this pricing language is of a list processing variety. Statements in the language consist entirely of lists of symbols presented for evaluation by processes written into 'C' programming language and embodied in the main vending control program.

The syntax and basic functions of vlisp are a proper subset of those used in various versions of the Lisp programming language employed widely in artificial intelligence research and application. (Though some function names have been changed to be more accessible to maintenance programmers not familiar with the Lisp language.)

Vlisp employs several extensions to conventional Lisp interpreters. It may obtain values from the vending machine's control program describing the member, member's rental history, tape, type of transaction, prior transaction, vending machine's physical state, day of the week and month, whether or not the day has been defined as a holiday and configuration of the vending machine by the host system for pricing variables. In addition, vlisp may refer to and invoke 'C' language functions compiled separately from the vlisp subsystem.

As a further extension to conventional Lisp, the vlisp interpreter is capable of interpreting and executing programs stored in text or "object" form. "Object" form vlisp programs are created from text programs and consist of lists of symbolic objects represented in a packed binary form. These objects are of several types, each type designed for efficient representation of a different type of data, including references to other objects and variables. As with other object-oriented programming systems, vlisp creates new objects by "inheriting" the characteristics for "ancestor" objects and adding attributes to them as necessary. However, the vlisp system does not implement a fully general-purpose inheritance capability.

Memory organization in the vlisp subsystem is more compact than in many conventional Lisp systems as multiple levels of reference indirection do not require multiple stored memory references or links. This is at the expense of somewhat reduced execution speed which is not critical in the vending machine environment while memory requirements are. "Garbage collection" of released memory is also somewhat simplified and is optimized to take advantage of the fast "block move" instructions available on the family of processors employed by the vending machine.

While under development, vlisp programs are represented in human-readable text. In operation they are normally distributed to vending machines by the host system in the more efficient object form.

When the vending control program is to create or modify a transaction it invokes the vlisp program interpreter to execute a vlisp program. This vlisp program defines the nature of the transaction to be created or modified based upon the contextual and physical facts made available to it by the control program. Once the vlisp program is completed, the control program stores the created transaction as appropriate.

In addition, the vlisp subsystem may alter system state variables which will cause the control program script steps to follow a different path under specified conditions. It also may induce the control program to print special receipts and display special messages, even messages intended for particular customers (e.g. "Please call our offices about a problem with your credit card.").

Vlisp program interpretation of one or more concurrent programs may proceed concurrently with other control program operations as vlisp participates in the overall multitasking system described above.

By employing the vlisp language, the vending machine may be configured to respond in arbitrarily complex ways to different pricing events. Complex promotions, discounts, incentives, allowances and customer rewards may be implemented by installing relatively short and simple vlisp programs without the need to alter the main control program. Because of their interpreted nature, vlisp programs require less memory resources during their execution than do fully compiled programs, thus reducing the overall cost of the system hardware.

The entire database is maintained in memory with disk backup. The "files" used are a member file, a tape file, an open transactions file, a tape title file, a key-to-title file, and a closed transactions file which alone is maintained on disk only. A transaction such as a rental, a return or a credit for a damaged tape is an association of a member, a tape, and an event. The event type, date, time and any variables of the event (such as rental price) are encoded in an open transaction record. This record also contains references to the associated member and tape records. In turn, tape records contain a reference to the last transaction created involving the particular tape, and member records contain multiple references to open transactions involving the member. Every reference within the database is doubly linked and reflexive so that a damaged database may be reconstructed. Closed transactions involving a return, a credit or a lost tape are written to disk as soon as they are created. Each closed transaction record written to disk has a 16-bit reverse CRC check appended.

All record locations within the member, tape, title and open transactions series are reclaimed when they become unused. For example, when an open rental transaction is closed by a return transaction for the same tape, the open transaction record for the rental is replaced by the new one for the return. If a return is modified by a credit transaction for a damaged tape, the credit transaction replaces the return transaction. When a member's credit card has expired, the associated member record is marked as unused. New member records are allocated on a first available transaction basis.

To further ensure file integrity, whenever a record in a disk file is update, the file is immediately closed and left closed until the next system start (when memory records are restored) or the next backup of a modified memory record.

Screen displays are drawn from files called "snap" files. Each snap file contains information on the video mode to be used in displaying the specified image, some checksum information and a bit map of the displayed image. The routines which display snap files are called with a snap number. They convert the snap number to a file name, find the file, confirm that it is a snap file, read the file into a buffer, set the appropriate video mode and copy the bit image to display memory. If the display mode is one serviceable with an IBM CGA type display system, optionally, the copy operation occurs only during horizontal or vertical video retrace time to avoid snow on CGA display adapters.

If a snap file cannot be found, the corresponding element of an array of default screen descriptions is used to form a message displayed instead of the desired screen. These same messages are used in diagnostics mode to copy to a trace file the content of each display screen shown.

If a snap file is called for and is already displayed on the screen and has not been modified on the screen no display operation takes place. Redundant screen references in the script have no significant impact on system performance.

In addition to entire screens, simple text may be overlaid on the screen. When this is done, a flag is set indicating the screen has been modified.

Snap files are built and maintained with utility programs running on any DOS machine with a display adapter capable of the video mode desired in the final snap file. These utilities center around a program designed to load and run any other DOS program. When loaded, this program replaces the usual PC print screen interrupt services with a process which builds a snap file from the currently displayed image. In this way, any DOS screen image can be made into a snap file.

In addition to full screen snap files, the display services of the system can display a smaller partial screen file called a "clip". Clip files contain all of the header information of a snap file, a smaller bit image and a specification of the default display location of the clip on the screen. When displayed, a clip may be overlaid on the screen or XOR'ed into the current screen. The clip may be displayed in its default screen location or some other location. If the placement of a clip would cause it to go beyond the screen boundaries, it is appropriately clipped. Clips may be used to enable special messages and some animation, if desired.

As both clip and snap files contain an image bit map, these files may become moderately large (especially for the IBM EGA type display system). To reduce disk space requirements and access times, and to make maintenance of screen images in memory practical, "pack" files are also supported.

Pack files are snap or clip files reduced in size through data compression and maintained usually in memory using a caching scheme. Five algorithms for recognizing and removing redundancy are applied to a snap file to obtain a pack file. Typically a pack file is about one-fifth the size of a corresponding snap file. Pack files are produced from snap or clip files using a utility program either on the vending machine or another computer.

To support pack files, before the vending control program searches for a snap file, it first checks to see if a pack file corresponding to the required snap file is currently in memory. If it is, the pack file contents are expanded back to snap file form and then displayed as any other snap file would be. If no corresponding pack file is found in memory, the system then checks to see if there is one on disk.

If no pack file is found on disk for a required screen the system goes on to seek a snap file for the same image.

Once a desired pack file is loaded into memory, it is then converted and displayed as if it had been found in memory when first sought.

Employing pack files causes the system to make optimum use of whatever memory and disk resources are available. As expansion from pack form to snap form is much more rapid than reading an image from disk files, the speed of the display subsystem is improved and absolute demands for system resources are reduced.

All operator input is through the keypad and four keys at the bottom of the screen. These keys are polled with a process invoked 18.2 times per second by the system clock interrupt. State changes are decoded into key presses by this process. Any input keys are placed in a queue for processing by another process.

The key input process which handles the key presses entered into the queue by the polling process is always in one of several states set by each program setup. The state set depends upon the type of input expected for the current script step. The types include yes/no responses, selection of one of the four keys below the CRT, input of a charge authorization number, input of a tape key number or no input at all. When no input is expected, key presses are discarded. In the other steps, validity checks and response echoing are handled by the keystroke input process. When invalid responses are received, error messages and try-again messages are generated by the same process. Once a successful input is achieved, its value is placed in the appropriate value within the system state structure and a system state flag indicating the type of input successfully obtained is set. Generally, by setting this flag, the progress of a script step is triggered.

In addition to processing keystrokes on the keypad and keys associated with the CRT, the input process watches for keys from the standard IBM-style serial keyboard input port. Characters received via this port may be from a conventional keyboard optionally attached to the system or from the bar code reader used to read tape box bar codes. The bar code reader is only capable of generating selected characters so that somewhat limited keyboard input can be processed along with bar code input on the same channel. In particular, a keyboard stroke terminating the program may be input from the conventional keyboard at any time that motors are not moving.

Optionally, the system may be configured to check credit card and debit card authorization with an on-line system. If so, modem communications are concurrent with other operations of the system. This is handled, together with communication to and from motor controllers, with a combination of concurrent processes and hardware interrupt handlers. In general, hardware interrupt handlers are used to process UART interrupts and place received characters in a queue or transmit outgoing characters from a queue. Transmissions are initiated an queue input is handled by asynchronous processes. In the case of credit card or debit card processing, the progress and success or failure of the remote transaction is posted to a system state flag accessible to the script process.

Communication between the host system and individual vending machines is 1200 or 2400 baud async with 8 bit data. In a simple session, the vending machine calls the host at a pre-defined time (if unsuccessful, it retries at preset intervals), a simple handshake occurs and the host requests the vending machine to send its closed transactions file. The vending machine time of day and date clock are synchronized to a master clock maintained by the host system and the conversation is complete. However, more complex communications are supported.

The hose may instruct the vending machine to receive any file, or to send any file resident in the vending machine. Also the host may specify a file and a complex record search pattern and instruct the vending system to transmit the first or all matching records, or only the offsets of such records within the file. Finally, the host may instruct the vending machine to replace any part of any file in the vending system.

The video tape renting machine and system of this invention is reliable, easy to operate, and can reduce the time spent by users in making a rental selection considerably. It provides the full range of customer functions required to make all the transactions necessary in a fully automatic videocassette rental procedure. The rotary drum storage system reduces storage space needed, and reduces tape retrieval time since the maximum distance a tape ever has to travel is one half revolution of the drum. The rotary transport mechanism eliminates the need to convert rotary to linear motion, which would otherwise introduce position errors, and thus simplifies position sensing.

Although a preferred embodiment of the invention has been described above by way of example only, it will be understood by those skilled in the field that modifications may be made to the disclosed embodiment without departing from the scope of the invention, which is defined by the appended claims.

What is claimed is:

1. A videotape rental machine, comprising:

an outer housing;

storage means within the housing having locations for storing a plurality of videocassettes comprising a square array of four rotatable drums in a plane parallel to the front panel of the housing, each said rotatable drum having a plurality of storage compartments around its periphery for storing of videotapes;

transport means for retrieving selected videotapes from their storage locations and delivering them to customers, and for retrieving returned videotapes from customers and returning them to associated storage locations comprising:

a rotatable picker assembly rotatable about an axis extending through the center of said array of drums and movable between a delivery position aligned with said delivery means and four pickup positions aligned with respective home storage compartment positions of said four drums, and drive means for rotating said picker assembly back and forth between said pickup positions and said delivery position and rotating said drums to position predetermined storage compartments at said pickup positions;

control means for controlling operation of said transport means, comprising:

means responsive to entry of a selection code on said selection device to control said transport means to retrieve the selected videotape from its storage location and deliver it to a customer; and a memory for storing data associating each storage location with a selection code representing a videotape to be stored at that location; the housing having a front panel comprising:

an array of separate display areas each containing pictorial indicia representing a particular videotape stored in the machine and the selection code associated with said particular videotape;

a selection device adjacent to said display area array and associated with said control means for allowing a customer to select a videotape by entering the selection code associated with that videotape on the selection device; and delivery means for delivering videocassettes to customers and receiving returned videocassettes.

2. The machine as claimed in claim 1, wherein each storage compartment is open at its front and rear ends, the picker assembly comprises an arm rotatably mounted on said center axis, a pickup member mounted on the free end of said arm and having a slot for carrying videocassettes which is aligned with the open front face of a storage compartment when at the home position of each drum, and videocassette ejection means for ejecting a videocassette from its storage compartment into the picker member, the ejector means including an extension arm projecting from said slot across the periphery of a drum at the home position and pusher means slidably mounted at the free end of the arm and movable into the rear end of the compartment to push a videocassette in the compartment out of the compartment and onto the picker member.

3. The machine as claimed in claim 1, wherein each drum has a backplate rotatably mounted on a rear wall of said housing, each backplate having teeth cut into its outer periphery, and said drive means includes a drum motor and a continuous drive chain extending around all four backplates and linked to said drum motor.

4. A videotape rental machine, comprising:

an outer housing;

storage means within the housing having locations for storing a plurality of videocassettes comprising:

a plurality of rotatable drums arranged in a single plane parallel to the front wall of the housing and rotatably mounted on the rear wall of the housing, each drum having a plurality of videocassette storage compartments around its outer periphery;

transport means for retrieving selected videotapes from their storage locations and delivering them to customers, and for retrieving returned videotapes from the customers and returning them to the associated storage locations comprising:

a rotatable picker assembly rotatable in a plane parallel to the front faces of the drums and between the drums and the front wall of the housing between said delivery position and a plurality of pickup positions including a pickup position aligned with a home position corresponding to a storage compartment position on each of the drums; and drive means for rotating said picker assembly back and forth between said pickup positions and said delivery position and rotating said drums to position predetermined storage compartments at said pickup position; and control means for controlling operation of said transport means, comprising:

means responsive to entry of a selection code on a selection device to control said transport means to retrieve the selected videotape from its storage location and deliver it to a customer; and a memory for storing data associating each storage location with a selection code representing a videotape to be stored at that location; the housing having a front panel comprising:

an array of separate display areas each containing pictorial indicia representing a particular videotape stored in the machine and the selection code associated with said particular videotape;

a selection device adjacent to said display area array and associated with said control means for allowing a customer to select a videotape on the selection code associated with that videotape on the selection device; and delivery means for delivering videocassettes to customers and receiving returned videocassettes.

5. The machine as claimed in claim 4, wherein said transport means includes means for rotating said pickup mechanism between said delivery position and said pickup positions, and means for rotating said drums to align predetermined storage compartments with the respective home positions.

6. The machine as claimed in claim 4, wherein said pickup mechanism comprises an arm rotatably mounted at one end on an axis extending transversely through the rear wall of the housing between the storage drums to rotate in a plane parallel to the drums, and a pickup assembly mounted at the free end of the arm, the pickup assembly including a slot for receiving a videocassette, detector means for detecting presence of a videocassette in the slot, and reversible picker drive means for driving videocassettes into and out of the slot.

7. The machine as claimed in claim 6, wherein the slot is open at both ends facing the drums and the front panel of the housing, respectively, and said reversible picker drive means comprises means for driving videocassettes into and out of opposite ends of the slot.

8. The machine as claimed in claim 7, wherein said control means comprises means responsive to entry of a valid selection code to drive said picker mechanism to the home position of the drum on which a copy of the selected videocassette is stored, and to drive said drum until the storage compartment containing said videocassette is at the home position, and to control said picker drive mechanism to drive said videocassette out of sad storage compartment and into said picker assembly slot, means responsive to detection of the arrival of said videocassette in said slot to drive said picker mechanism to said delivery position and to control said picker drive mechanism to drive said videocassette out of the opposite, second end of said slot and into said delivery means.

9. The machine as claimed in claim 8, wherein said control means includes means responsive to detection of user return of a videocassette into said delivery means to control said picker drive mechanism to drive said returned videocassette into the second end of said slot, means for identifying the returned videocassette and associating it with its predetermined storage location on one of the storage drums, means responsive to detection of the arrival of the videocassette in said slot for driving said picker mechanism to the home position of the drum on which that videocassette is to be stored, means for rotating the drum until the predetermined storage location of the videocassette is at the home position, and means for controlling the picker drive means to drive the videocassette out of the first end of the slot and into the storage compartment.

10. The machine as claimed in claim 6, wherein the picker drive means includes a reversible conveyer belt assembly for driving videocassettes into and out of the opposite ends of the slot, ejector means for urging a videocassette out of its storage compartment and onto the conveyer belt assembly at the first end of the slot, and injector means for urging a videocassette off the conveyer belt assembly and into its storage compartment.

11. The machine as claimed in claim 10, wherein said ejector means comprises an extension arm projecting from the picker assembly across the peripheral edges of the drums towards the rear of the drum, and an ejector bar slidably mounted on the arm and projecting upwardly from it to extend upwardly behind a storage compartment when the picker mechanism is located at the home position of one of the drums, and ejector drive means for driving the ejector bar between an inoperative position at the free end of the extension arm and an operative position in which it pushes a videocassette out of the storage compartment and onto the conveyer belt assembly.

12. The machine as claimed in claim 11, wherein the injector means comprises an injector bar slidably mounted on the inner end of the extension arm, and injector drive means for driving said injector bar between an inoperative, retracted position and an operative position in which it engages the end of a videocassette leaving the conveyer belt assembly and pushes it completely into an aligned storage compartment.

* * * * *